US010763069B2

(12) United States Patent
Kumadaki et al.

(10) Patent No.: US 10,763,069 B2
(45) Date of Patent: Sep. 1, 2020

(54) X-RAY TUBE AND METHOD OF MANUFACTURING THE SAME

(71) Applicant: Canon Electron Tubes & Devices Co., Ltd., Otawara-shi (JP)

(72) Inventors: Hiroyuki Kumadaki, Nasushiobara (JP); Tomonobu Saito, Yaita (JP); Hidero Anno, Otawara (JP)

(73) Assignee: Canon Electron Tubes & Devices Co., Ltd., Otawara-shi (JP)

( * ) Notice: Subject to any disclaimer, the term of this patent is extended or adjusted under 35 U.S.C. 154(b) by 224 days.

(21) Appl. No.: 15/868,243

(22) Filed: Jan. 11, 2018

(65) Prior Publication Data

US 2018/0197712 A1 Jul. 12, 2018

(30) Foreign Application Priority Data

Jan. 12, 2017 (JP) ..... 2017-003524

(51) Int. Cl.
*H01J 35/06* (2006.01)
*H01J 35/14* (2006.01)
*H01J 9/04* (2006.01)

(52) U.S. Cl.
CPC ..... *H01J 35/06* (2013.01); *H01J 9/042* (2013.01); *H01J 35/14* (2013.01)

(58) Field of Classification Search
CPC ..... H01J 9/042; H01J 35/14; H01J 35/06
See application file for complete search history.

(56) References Cited

U.S. PATENT DOCUMENTS 3,943,393 A 3/1976 Naill
4,433,230 A * 2/1984 Sano ..... B01J 3/006 219/118
4,764,947 A * 8/1988 Lesensky ..... H01J 35/06 313/452

(Continued)

FOREIGN PATENT DOCUMENTS

CN 85106786 A 4/1987
CN 105990077 A 10/2016

(Continued)

OTHER PUBLICATIONS

Combined Chinese Office Action and Search Report dated Jun. 4, 2019, in Patent Application No. 201810026490.0, citing documents AA-AC and AO-AP therein, 18 pages (with English translation).

*Primary Examiner* — David P Porta
*Assistant Examiner* — Djura Malevic
(74) *Attorney, Agent, or Firm* — Oblon, McClelland, Maier & Neustadt, L.L.P.

(57) ABSTRACT

According to one embodiment, an X-ray tube, including a cathode including a filament including a leg portion extending from a coil to a distal portion and including a corner portion at the distal portion, a support terminal including a gap, and including an opening portion in which the gap is opened and a bottom portion located on a side opposite to the opening portion, and a cathode cup being connected to the support terminal, the distal portion being located in the gap, the support terminal including a protruding portion protruding in the gap, being located more closely to the bottom portion side than the distal portion, and being joined to the corner portion of the leg portion.

13 Claims, 21 Drawing Sheets

(56) References Cited

U.S. PATENT DOCUMENTS

| | | | | | |
|---|---|---|---|---|---|
| 4,825,123 | A * | 4/1989 | Franzel | H01J 35/06 | 313/452 |
| 5,515,413 | A * | 5/1996 | Knudsen | H01J 35/06 | 378/136 |
| 5,526,396 | A * | 6/1996 | Jacob | H01J 35/06 | 378/121 |
| 5,920,605 | A * | 7/1999 | Lu | H01J 35/06 | 378/119 |
| 6,373,922 | B1 * | 4/2002 | Dalpe | H01J 9/00 | 378/136 |
| 6,661,876 | B2 * | 12/2003 | Turner | G01N 23/223 | 378/138 |
| 9,916,959 | B2 * | 3/2018 | Foellmer | H01J 35/06 | |
| 10,068,740 | B2 * | 9/2018 | Gupta | A61B 6/032 | |
| 2010/0040201 | A1 * | 2/2010 | Lee | H01J 35/06 | 378/136 |

FOREIGN PATENT DOCUMENTS

| | | |
|---|---|---|
| JP | 8-241685 | 9/1996 |
| JP | 2005-302368 | 10/2005 |

* cited by examiner

X-RAY TUBE AND METHOD OF MANUFACTURING THE SAME

CROSS-REFERENCE TO RELATED APPLICATIONS

This application is based upon and claims the benefit of priority from Japanese Patent Application No. 2017-003524, filed Jan. 12, 2017, the entire contents of which are incorporated herein by reference.

FIELD

Embodiments described herein relate generally to an X-ray tube and a method of manufacturing the same.

BACKGROUND

An X-ray tube comprises a cathode which emits electrons and an anode target which irradiates X-rays by collision of the emitted electrons, in a vacuum envelope in a vacuum atmosphere. The cathode comprises an electron emission source and a cathode cup which accommodates the electron emission source. The electron emission source is composed of a filament which emits electrons and a support terminal which supports the filament. The filament is provided to be electrically insulated from the cathode cup. The filament is joined to the support terminal by welding or the like.

The filament is heated by heat generated by a flowing current and emits electrons (thermoelectrons) to the anode target. The filament is repeatedly heated in accordance with emission of the electrons and strength of the joint between the filament and the support terminal is thereby reduced. The filament may be therefore displaced from the joint of the support terminal. A focal position of the electrons on the anode target may be displaced by displacement of the filament. In addition, the filament may be brought into contact with the cathode cup (filament touch). If the filament is brought into contact with the cathode cup, a current may not flow to the filament.

The embodiments have been accomplished in consideration of this point and aim to provide an X-ray tube and an X-ray tube manufacturing method that can prevent displacement of the filament of the cathode.

DETAILED DESCRIPTION

In general, according to one embodiment, an X-ray tube, comprises: a cathode comprising: a filament comprising a coil emitting electrons, and a leg portion extending from the coil to a distal portion and including a corner portion at the distal portion; a support terminal including a gap, and comprising an opening portion in which the gap is opened and a bottom portion located an end portion of the gap on a side opposite to the opening portion; and a cathode cup accommodating the filament and the support terminal and being connected to the support terminal, the distal portion being located in the gap, the support terminal comprising a protruding portion protruding in the gap, being located more closely to the bottom portion side than the distal portion, and being joined to the corner portion of the leg portion.

According to another embodiment, a method of manufacturing an X-ray tube comprising a cathode, the cathode comprising: a filament comprising a coil emitting electrons, and a leg portion extending from the coil to a distal portion and including a corner portion at the distal portion; a support terminal including a gap, and comprising an opening portion in which the gap is opened and a bottom portion located an end portion of the gap on a side opposite to the opening portion; and a cathode cup accommodating the filament and the support terminal and being connected to the support terminal, the method comprising: inserting the distal portion of the leg portion into the gap of the support terminal; supplying a current while applying a pressure to a first surface of the support terminal on an outer side and a second surface of the support terminal located outside on an opposite side with the corner portion of the leg portion sandwiched between the first surface and the second surface, by a pair of electrodes; urging a third surface of the support terminal and a fourth surface opposed to the third surface to abut on the corner portion in the gap; and joining the third surface and the fourth surface to the corner portion.

The embodiments will be described hereinafter with reference to the accompanying drawings.

First Embodiment

Figure 1:
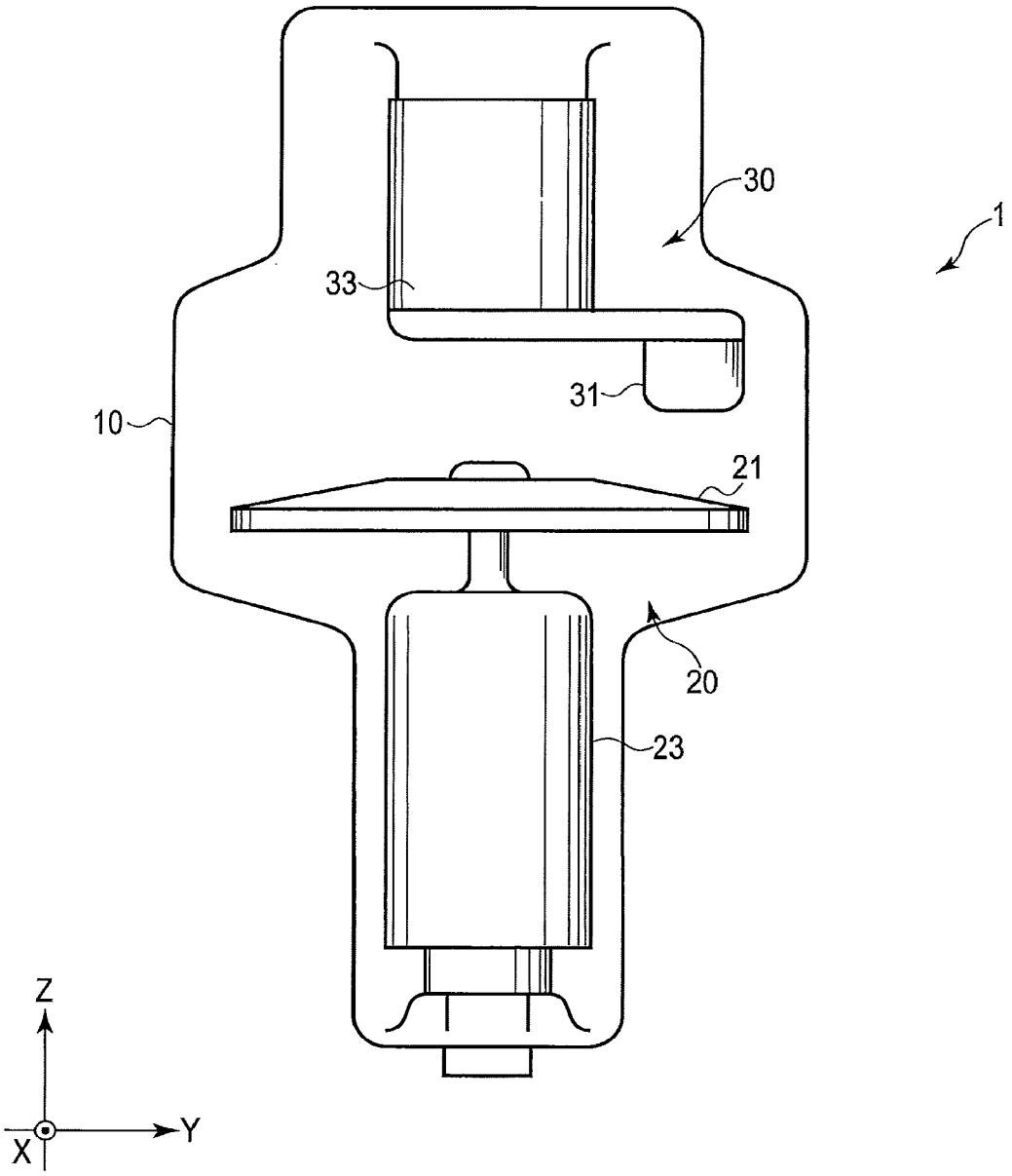
FIG. 1 is an illustration showing an example of an X-ray tube according to First Embodiment.

FIG. 1 is an illustration showing an example of an X-ray tube 1 according to the First Embodiment. A first direction X, a second direction Y, and a third direction Z are orthogonal to each other.

An X-ray tube 1 comprises a vacuum envelope 10, an anode body structure 20, and a cathode body structure 30. The vacuum envelope 10 is formed of, for example, a glass valve formed of glass. The vacuum envelope 10 includes the anode body structure 20 and the cathode body structure 30 in the inside which is maintained in a vacuum atmosphere.

The anode body structure 20 comprises an approximately umbrella-shaped anode target (target disc) 21 and a rotation mechanism 23. The anode target 21 is formed in an umbrella-like and approximately disc shape. Electrons (electron beams) collide with an umbrella-shaped surface of the anode target 21 and the anode target 21 thereby emits X-rays. The anode target 21 is supported by the rotation mechanism 23. The anode target 21 rotates in accordance with the rotation of the rotation mechanism 23. The anode target 21 is composed of a target layer which emits X-rays and a target base which supports the target layer. The target layer is formed of, for example, tungsten. The target base is formed of, for example, molybdenum alloy (TZM). In addition, a stator coil (not shown) is provided outside the vacuum envelope 10. The stator coil generates a magnetic field by being supplied with a current from a power supply (not shown) and urges the rotation mechanism 23 to be rotated by the generated magnetic field.

The cathode body structure 30 comprises a cathode 31 and a cathode supporter 33. The cathode 31 faces the anode target 21 inside the vacuum envelope 10. A high voltage is applied to the cathode 31 and the cathode 31 thereby emits electrons (electron beams) to the anode target 21.

Figure 2:
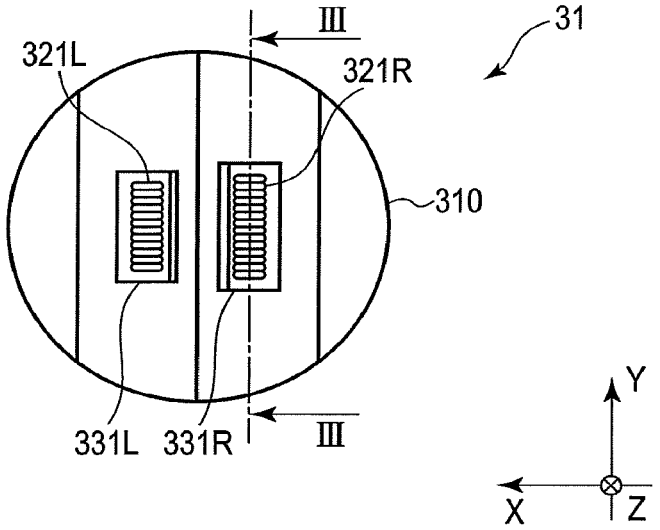
FIG. 2 is a front view showing an example of a cathode.

FIG. 2 is a front view showing an example of cathode 31. FIG. 2 shows the cathode 31 on the X-Y plane seen from the third direction Z.

The cathode 31 comprises a cathode cup (converging electrode) 310 and at least one electron emission source, for example, two electron emission sources 321R and 321L.

The cathode cup 310 controls electrons emitted from the electron emission source. For example, the cathode cup 310 is supplied with a current and thereby urges the electrons emitted from the electron emission sources 321R and 321L to be converged at a focus on the anode target 21. In the example illustrated in FIG. 2, two groove portions 331R and 331L to accommodate the electron emission sources are formed on the cathode cup 310. The electron emission sources 321R and 321L are provided in accommodation grooves on bottom portions of the groove portions 331R and 331L, respectively. Each of the electron emission sources 321R and 321L emits electrons toward the anode target 21.

Figure 3:
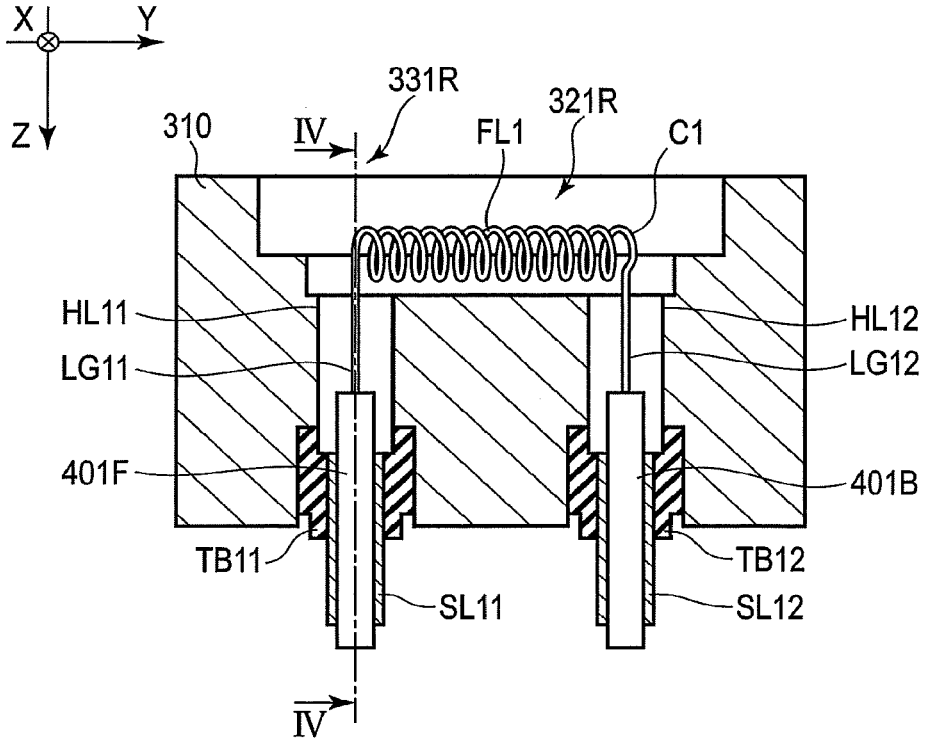
FIG. 3 is a partially sectional view showing a part of a structure of the cathode.

FIG. 3 is a partially sectional view showing a part of the structure of the cathode 31. FIG. 3 is a partially sectional view showing the cathode 31 when seeing the Y-Z plane from the first direction X. The electron emission source 321R and a partial section of the cathode cup 310 cut along line in FIG. 2 are schematically shown in FIG. 3. FIG. 3 shows the electron emission source 321R alone for convenience of explanations but the electron emission source 321L may also be configured similarly. The electron emission source 321R will be explained below but the electron emission source 321L can also be explained similarly to the electron emission source 321R.

Holes HL11 and HL12 are formed in the groove portion 331R of the cathode cup 310. As shown in FIG. 3, the holes HL11 and HL12 are separated from each other. Each of the holes HL11 and HL12 extends in the third direction Z. Tubular portions TB11 and TB12 are provided in the holes HL11 and HL12, respectively, by a method such as caulking or brazing. The tubular portions TB11 and TB12 are formed of an insulating material in a cylindrical shape. Sleeves SL11 and SL12 are provided in the tubular portions TB11 and TB12, respectively, by a method such as caulking or brazing. The sleeves SL11 and SL12 are formed in a cylindrical shape.

The electron emission source 321R comprises a filament FL1 and a pair of support terminals (terminals or anchor portions) 401F and 401B. The filament FL1 comprises a coil portion C1 and a pair of leg portions LG11 and LG12 extending from the coil portion C1. The filament FL1 is formed of, for example, tungsten or an alloy containing tungsten as its main component. The coil portion C1 is supplied with a current and thereby heated, and emits electrons (thermoelectrons). The coil portion C1 is separated from an inner surface of the groove portion 331R of the cathode cup 310. In the example illustrated in FIG. 3, the coil portion C1 is provided parallel to a bottom surface of the groove portion 331R and extends in the second direction Y. The leg portion LG11 extends from an end portion of the coil portion C1 in a direction, for example, toward the inside of the hole HL11 in the third direction Z. The leg portion LG12 extends from the other end portion of the coil portion C1 which is located on the side opposite to the leg portion LG11, in a direction, for example, toward the inside of the hole HL12 in the third direction Z. The leg portions LG11 and LG12 are formed in a rod shape, for example, a columnar shape. The leg portions LG11 and LG12 are supported by support terminals 401F and 401B, respectively. Each of the support terminals 401F and 401B passes a current supplied from a power source (not shown) to the coil portion C1 of the filament FL1. The support terminals 401F and 401B are formed of, for example, iron, an alloy containing iron as its main component, niobium, or an alloy containing niobium as its main component. The support terminals 401F and 401B are fixed to sleeves SL11 and SL12, respectively. The support terminals 401F and 401B are electrically insulated from the cathode cup 310 via the sleeves SL11 and SL12 by tubular portions TB11 and TB12, respectively. In other words, the electron emission source 321R is electrically insulated from the cathode cup 310.

Figure 4A:
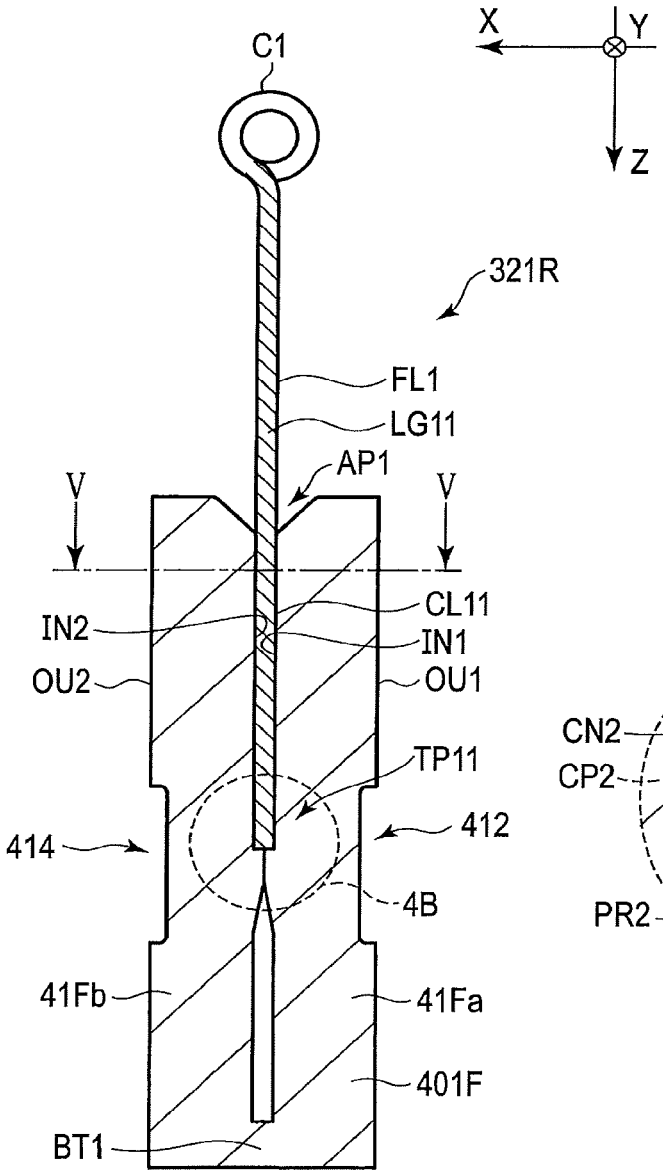
FIG. 4A is an expanded sectional view showing an example of an electron emission source.
Figure 4B:
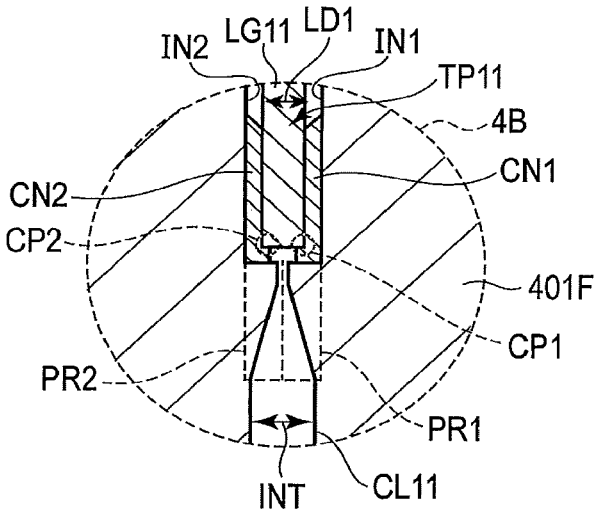
FIG. 4B is an expanded sectional view showing an example of a distal portion of a leg portion.

FIG. 4A and FIG. 4B are cross-sectional views showing an example of a structure of the electron emission source 321R cut along IV-IV shown in FIG. 3. FIG. 4A and FIG. 4B show an example of a section of the electron emission source 321R when seeing the X-Z plane from the second direction Y. The structure of the cathode 31 other than the electron emission source 321R is not shown in FIG. 4A and FIG. 4B. For convenience of explanations, the only structure of the support terminal 401F and the leg portion LG11 of the filament FL1 is shown but the same structure can also be applied to the leg portion LG12 and the support terminal 401B. Therefore, the leg portion LG11 and the support terminal 401F will be explained below, but the leg portion LG12 and the support terminal 401B can be explained similarly to the leg portion LG11 and the support terminal 401F. FIG. 4A is an expanded sectional view showing an example of the electron emission source 321R. FIG. 4B is an expanded sectional view showing an example of a distal portion TP11 of the leg portion LG11.

A gap (slit) CL11 is formed in the support terminal 401F. In the example illustrated in FIG. 4A, the gap CL11 in the support terminal 401F is formed horizontally in the Y-Z plane. In other words, the gap CL11 is formed horizontally to the plane horizontal to the filament FL1, in the support terminal 401F. The gap CL11 includes an opening portion AP1 which opens to one direction. In the following explanations, one of portions of the support terminal 401F based on the gap CL11 is called a first terminal portion 41Fa and the other portion is called a second terminal portion 41Fb. The direction of the opening portion AP1 is called an opening portion side, in the support terminal 401F. A part of the support terminal 401F located at the end portion of the gap CL11 which is opposed to the opening portion side is called a bottom portion. The direction of the bottom portion is called a bottom portion side, in the support terminal 401F. In addition, in the first direction X, the direction toward the gap CL11 is called an inner side and the direction opposed to the inner side is called an outer side. An inner surface of the first terminal portion 41Fa is called an inner surface IN1 and an outer surface of the first terminal portion 41Fa is called an outer surface OU1. An inner surface of the second terminal portion 41Fb is called an inner surface IN2 and an outer surface of the second terminal portion 41Fb is called an outer surface OU2. The gap CL11 in the support terminal 401F may not be formed horizontally to the plane horizontal to the filament FL1, for example, the Y-Z plane. For example, the gap CL11 in the support terminal 401F may be formed obliquely to the plane horizontal to the filament FL1, for example, the Y-Z plane. The outer surface OU2 is located on the side opposite to the outer surface OU1 with the gap CL11 sandwiched between the outer surfaces. In addition, the support terminal 401F may be provided obliquely with the filament FL1.

The support terminal 401F comprises a pair of depressions on the outer surfaces. In the example illustrated in FIG. 4A, the support terminal 401F comprises a pair of depressions 412 and 414. The depressions 412 and 414 are formed on the outer surfaces OU1 and OU2 of the support terminal 401F, respectively. The depression 412 is opposed to the depression 414 with the gap CL11 sandwiched between the depressions. The leg portion LG11 extends from the coil portion C1 to the end portion (hereinafter called a distal portion) TP11 on the side opposite to the coil portion C1. In the example illustrated in FIG. 4A, the distal portion TP11 of the leg portion LG11 is located between the depressions 412 and 414, in the gap CL11.

The support terminal 401F comprises a protruding portion which protrudes inside the gap CL11. In the example illustrated in FIG. 4B, the support terminal 401F includes two protruding portions PR1 and PR2 which are opposite to each other inside the gap CL11. The protruding portion PR1 is formed such that inner surface IN1 of the first terminal portion 41Fa of the support terminal 401F protrudes inwardly. The protruding portion PR2 is formed such that the inner surface IN2 of the second terminal portion 41Fb of the support terminal 401F protrudes inwardly, similarly to the protruding portion PR1. In the example illustrated in FIG. 4B, the protruding portions PR1 and PR2 are separated in a distance smaller than a width INT of the gap CL11 in the first direction X. For example, the protruding portions PR1 and PR2 are separated in a distance smaller than a diameter (or a width in the first direction X) LD1 of the leg portion LG11. In addition, the protruding portions PR1 and PR2 are separated on the side of the opening portion from a bottom portion BT1, in the third direction Z. The protruding portions PR1 and PR2 are separated but may be contacted (welded by pressure or crimped) or joined (welded). In addition, the protruding portions PR1 and PR2 may be in a different shape. For example, the protruding portion PR1 may protrude more inwardly than the protruding portion PR2. For example, at least one of the protruding portions PR1 and PR2 may be spaced apart but may be contacted (welded by pressure or crimped) or joined (welded).

The leg portion LG11 includes a corner portion at the distal portion TP11. The corner portion of the distal portion TP11 of the leg portion LG11 is fixed to the protruding portions PR1 and PR2 and the inner surfaces IN1 and IN2. The corner portion is a portion at which two or more planes and lines intersect at a certain angle. A point of intersection at which two or more planes and lines intersect at a certain angle at the corner portion is often called a corner. For example, the corner portion is a portion extending from the bottom surface of the distal portion TP11 of the leg portion LG11 along a side surface. For convenience of explanations, the inner surface IN1 side of the corner portion of the leg portion LG11 is hereinafter called corner portion CP1, and the inner surface IN2 side is called a corner portion CP2. In the example illustrated in FIG. 4B, the corner portion CP1 of the leg portion LG11 is fixed to the protruding portion PR1 and the inner surface IN1 of the first terminal portion 41Fa via a joint portion CN1. The corner portion CP2 is fixed to the protruding portion PR2 and the inner surface IN2 of the second terminal portion 41Fb via a joint portion CN2, similarly to the corner portion CP1. At this time, for example, the protruding portion PR1 is located more closely to the bottom portion side than the distal portion TP11 and joined to the bottom surface side of the corner portion CP1. The protruding portion PR2 is located more closely to the bottom portion side than the distal portion TP11 and joined to the bottom surface side of the corner portion CP2, similarly to the protruding portion PR1. The inner surface IN1 is joined to the side surface side of the corner portion CP1. The inner surface IN2 is joined to the side surface side of the corner portion CP2. The corner portion CP1 of the leg portion LG11 may be fixed to at least one of the protruding portion PR1 and the inner surface IN1 of the first terminal portion 41Fa via the joint portion CN1. The corner portion CP2 of the leg portion LG11 may be fixed to at least one of the protruding portion PR2 and the inner surface IN2 of the second terminal portion 41Fb via the joint portion CN2.

Each of the joint portions CN1 and CN2 is formed of a conductive metallic member. For example, the joint portion CN1 is formed by melting at least one of the corner portion CP1 of the leg portion LG11 and the inner surface IN1 (and the protruding portion PR1) of the support terminal 401F. The joint portion CN2 is formed by melting at least one of the corner portion CP2 of the leg portion LG11 and the inner surface IN2 (and the protruding portion PR2) of the support terminal 401F. In the example illustrated in FIG. 4B, the joint portions CN1 and CN2 are separated from each other. The joint portion CN1 may be formed integrally with at least one of the corner portion CP1 of the leg portion LG11 and the inner surface IN1 (and the protruding portion PR1) of the support terminal 401F. The joint portion CN2 may be formed integrally with at least one of the corner portion CP2 of the leg portion LG11 and the inner surface IN2 (and the protruding portion PR2) of the support terminal 401F.

Figure 25A:
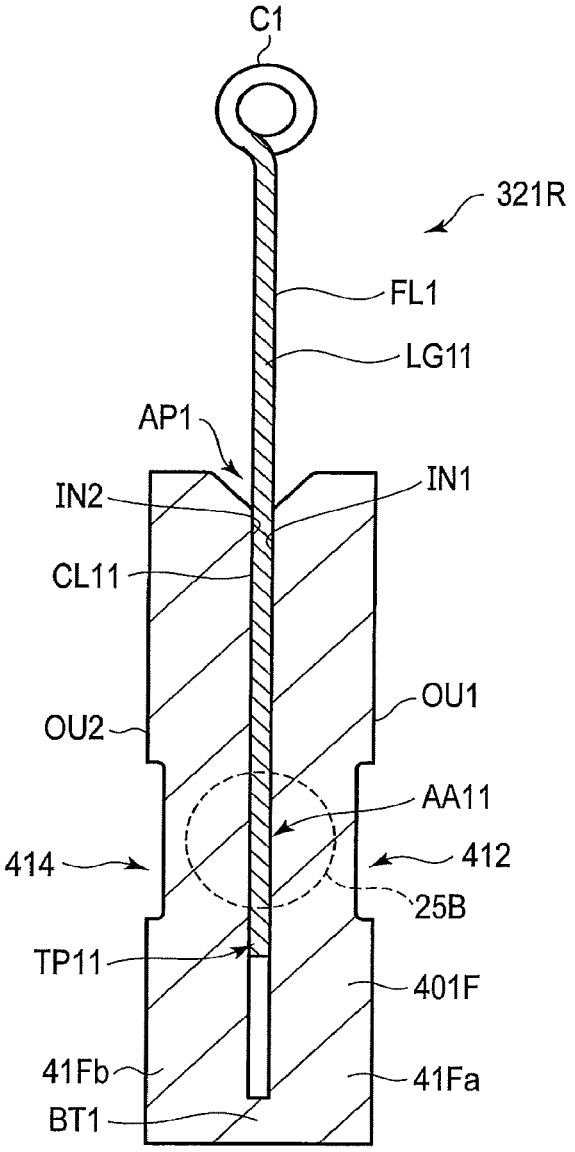
FIG. 25A is an expanded sectional view showing an example of an electron emission source according to a comparative example.
Figure 25B:
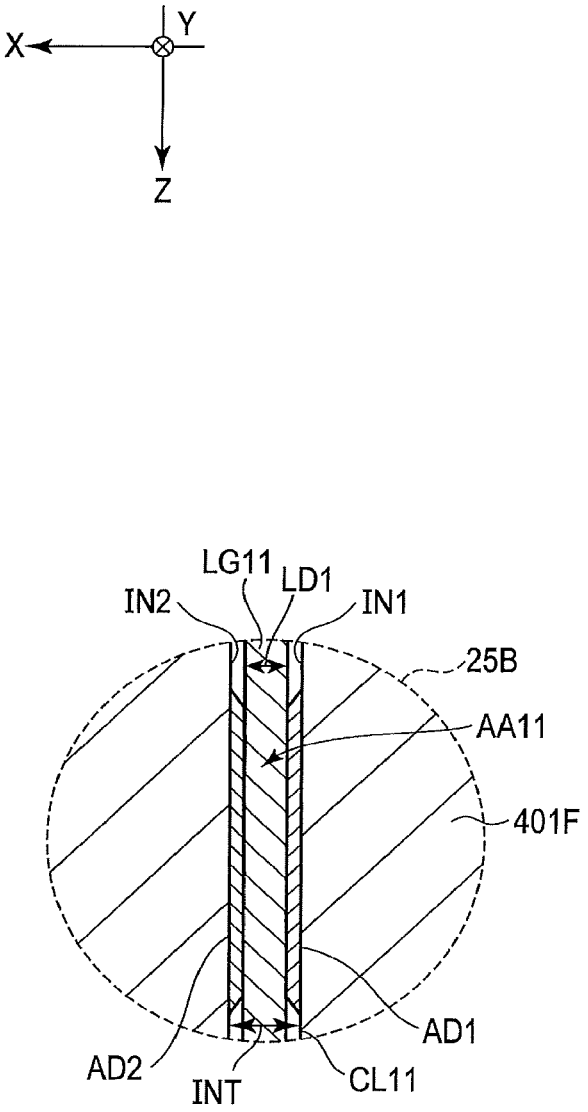
FIG. 25B is an expanded sectional view showing an example of the fixed portion of the leg portion according to the comparative example.

FIG. 25A and FIG. 25B are cross-sectional views showing an example of a structure of the electron emission source 321R according to a comparative example. FIG. 25A and FIG. 25B show an example of a section of the electron emission source 321R when seeing the X-Z plane from the second direction Y, similarly to FIG. 4A and FIG. 4B. The electron emission source 321R according to the comparative example shown in FIG. 25A and FIG. 25B has substantially the same structure as the electron emission source 321R according to the present embodiment shown in FIG. 4, portions like or similar to those of the electron emission source 321R of the present embodiment are denoted by the same reference numbers and their detailed descriptions are omitted. FIG. 25A is an expanded sectional view showing an example of the electron emission source 321R according to the comparative example. FIG. 25B is an expanded sectional view showing an example of a fixed portion AA11 of the leg portion LG11 according to the comparative example.

In the example illustrated in FIG. 25A, the fixed portion AA11 of the leg portion LG11 is located between the depressions 412 and 414. The fixed portion AA11 is a part of the leg portion LG11 located more closely to the coil portion C1 side than the distal portion TP11. For this reason, the distal portion TP11 of the leg portion LG11 is located more closely to the bottom portion side than the range sandwiched between the depressions 412 and 414, in the gap CL11.

In the example illustrated in FIG. 25B, the fixed portion AA11 of the leg portion LG11 is fixed to the inner surface IN1 via a joint portion AD1 and fixed to the inner surface IN2 via a joint portion AD2. The joint portion AD1 is formed by melting at least one of the fixed portion AA11 of the leg portion LG11 and the inner surface IN1 of the support terminal 401F. The joint portion AD2 is formed by melting at least one of the fixed portion AA11 of the leg portion LG11 and the inner surface IN2 of the support terminal 401F. Each of the joint portions AD1 and AD2 is formed of a conductive metallic member. The joint portion AD1 may be formed integrally with at least one of the fixed portion AA11 of the leg portion LG11 and the inner surface IN1 of the support terminal 401F. The joint portion AD2 may be formed integrally with at least one of the fixed portion AA11 of the leg portion LG11 and the inner surface IN2 of the support terminal 401F.

In the comparative example, the support terminal 401F is welded by pressure (or crimped) on the leg portion LG11 by welding, for example, resistance welding (spot welding) at the manufacturing time. Resistance welding is a manner of welding of superposing a plurality of members to be welded, holding a part to be welded in the superposed members between a pair of electrodes, supplying a current while applying a pressure to the part to be welded by the electrodes, and welding and joining the part with Joule heat which is generated at a contact resistance of the part by supplying the current. If the support terminal 401F is joined to the leg portion LG11 by resistance welding, a part of the support terminal 401F which corresponds to the position of the fixed portion AA11 is sandwiched between the electrodes from the outside, a force is exerted on this part and a current is supplied to the part. The inner surfaces IN1 and IN2 of the support terminal 401F protrude to the fixed portion AA11 of the leg portion LG11 by the force exerted by the electrodes and are made to abut on the fixed portion AA11 of the leg portion LG11. At this time, for example, each of the inner surfaces IN1 and IN2 of the support terminal 401F is brought into line contact with the fixed portion AA11 of the leg portion LG11. In this case, the force exerted on the support terminal 401F by the electrodes is dispersed at the part at which each of the inner surfaces IN1 and IN2 of the support terminal 401F is brought into line contact with the fixed portion AA11 of the leg portion LG11. In other words, a stress generated at the part in line contact becomes smaller. For this reason, each of the inner surfaces IN1 and IN2 of the support terminal 401F is not sufficiently crimped on the fixed portion AA11 of the leg portion LG11. The current supplied by the electrodes is therefore dispersed at the part at which the inner surfaces IN1 and IN2 of the support terminal 401F are brought into line contact with the fixed portion AA11 of the leg portion LG11. In other words, a current density at the part in line contact becomes smaller. For this reason, the inner surfaces IN1 and IN2 of the support terminal 401F may not be joined to the fixed portion AA11 of the leg portion LG11 with a sufficient strength.

In contrast, in the present embodiment, the support terminal 401F is joined (welded) on the leg portion LG11 by welding, for example, resistance welding at the manufacturing time. If the support terminal 401F is joined to the leg portion LG11 by resistance welding, a part of the support terminal 401F which corresponds to the position of the distal portion TP11 of the leg portion LG11 is sandwiched between the electrodes from the outside, a force is exerted on this part and a current is supplied to the part. The inner surfaces IN1 and IN2 of the support terminal 401F protrude to the distal portion TP11 of the leg portion LG11 by the force exerted by the electrodes and are made to abut on the corner portions CP1 and CP2. At this time, for example, the inner surface IN1 is made to abut on a corner of the corner portion CP1 and plastically deformed to cover the corner portion CP1. The inner surface IN2 is made to abut on a corner of the corner portion CP2 and plastically deformed to cover the corner portion CP2, similarly to the inner surface IN1. At this time, the inner surface IN1 is plastically deformed and the protruding portion PR1 is thereby formed on the bottom portion side. The inner surface IN2 is plastically deformed and the protruding portion PR2 is thereby formed. At this time, the force exerted on the support terminal 401F by the electrodes is concentrated on the part at which the inner surfaces IN1 and IN2 of the support terminal 401F are brought into contact with the corners of the corner portions CP1 and CP2 of the distal portion TP11, respectively. In other words, a stress generated at the part in contact becomes larger. For this reason, the inner surfaces IN1 and IN2 of the support terminal 401F are sufficiently crimped on the corner portions CP1 and CP2 of the leg portion LG11. In other words, the inner surfaces IN1 and IN2 of the support terminal 401F are sufficiently crimped on the corner portions CP1 and CP2 of the leg portion LG11 in narrower range as compared with a case in which the inner surfaces are brought into contact. For this reason, the current supplied by the elements mainly flows at the part at which the inner surfaces IN1 and IN2 of the support terminal 401F are brought into contact with the corner portions CP1 and CP2 of the distal portion TP11. In other words, a current density at the part in contact becomes larger. The inner surfaces IN1 and IN2 (and the protruding portions PR1 and PR2) of the support terminal 401F can be therefore joined to the corner portions CP1 and CP2 of the leg portion LG11 with a sufficient strength.

Figure 5A:
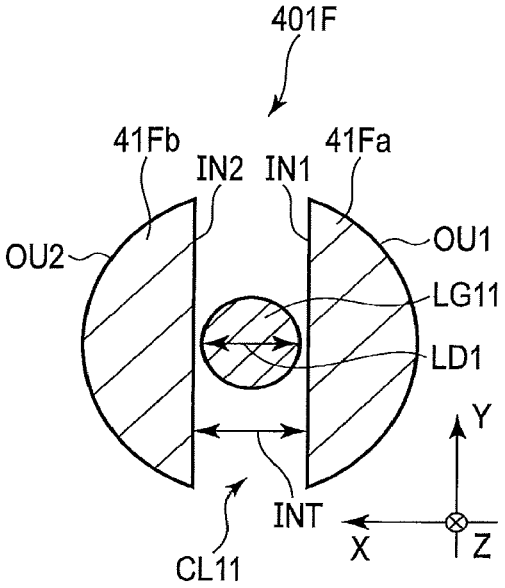
FIG. 5A is a cross-sectional view showing an example of a support terminal in which each of sections of a first terminal portion and a second terminal portion is formed in a rectangular shape.
Figure 5B:
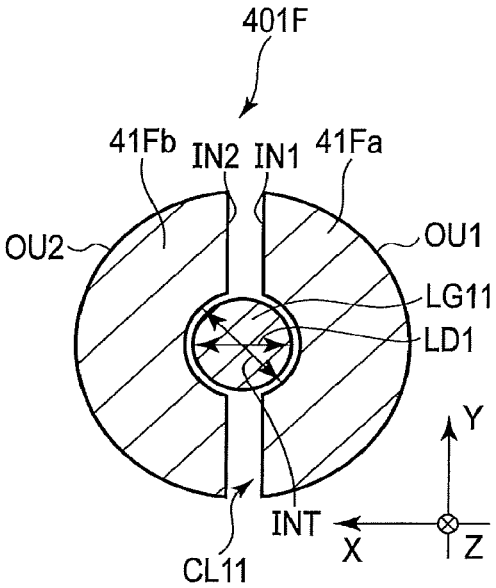
FIG. 5B is a cross-sectional view showing an example of a support terminal in which each of parts of the sections of the first terminal portion and the second terminal portion is formed along a shape of a leg portion.

FIG. 5A and FIG. 5B are cross-sectional views showing several examples of the partial structure of the support terminal 401F cut along V-V shown in FIG. 4. FIG. 5A and FIG. 5B show several examples of a section of the support terminal 401F when seeing the X-Y plane from the third direction Z. FIG. 5A is a cross-sectional view showing an example of the support terminal 401F in which each of sections of a first terminal portion 41Fa and a second terminal portion 41Fb is formed in a semicircular shape. FIG. 5B is a cross-sectional view showing an example of the support terminal 401F in which each of sections of the first terminal portion 41Fa and the second terminal portion 41Fb is formed in a fan shape.

In the example illustrated in FIG. 5A, each of the sections of the first terminal portion 41Fa and the second terminal portion 41Fb of the support terminal 401F is formed in a semicircular shape. The first terminal portion 41Fa and the second terminal portion 41Fb of the support terminal 401F are opposed with the leg portion LG11 sandwiched between the terminal portions. In the example illustrated in FIG. 5A, the support terminal 401F can prevent displacement of the leg portion LG11 to a direction vertical with the plane horizontal to the filament FL1, for example, the first direction X of the leg portion LG11. In the example illustrated in FIG. 5B, each of the sections of the first terminal portion 41Fa and the second terminal portion 41Fb of the support terminal 401F is formed in a fan shape. Each of a part of the inner surface IN1 of the first terminal portion 41Fa and a part of the inner surface IN2 of the second terminal portion 41Fb, of the support terminal 401F, is formed in an arch shape along the outer peripheral shape of the leg portion LG11. In the support terminal 401F, a part of the inner surface IN1 and a part of the inner surface IN2 which are not formed in an arch shape are opposed parallel. In addition, the part of the inner surface IN1 and the part of the inner surface IN2 which are not formed in an arch shape are separated in a distance smaller than the diameter LD1 of the leg portion LG11. The first terminal portion 41Fa and the second terminal portion 41Fb of the support terminal 401F are opposed with the leg portion LG11 sandwiched between the terminal portions. The leg portion LG11 is located between the part of the inner surface IN1 and the part of the inner surface IN2 of the second terminal portion 41Fb which are formed in an arch shape. In the example illustrated in FIG. 5B, the support terminal 401F can prevent displacement of the leg portion LG11 to a direction vertical with the plane horizontal to the filament FL1, for example, the first direction X. In addition, the support terminal 401F can also prevent displacement of the leg portion LG11 to a direction horizontal to the plane horizontal to the filament FL1, for example, the second direction Y. The sectional shape of the support terminal 401F shown in FIG. 5A and FIG. 5B is a mere example and may be a sectional shape other than this. For example, the section of the support terminal 401F may be formed in a rectangular shape. In addition, the gap CL11 may be formed obliquely in the section of the support terminal 401F.

An example of a method of manufacturing the electron emission source 321R according to the present embodiment will be hereinafter explained with reference to FIG. 6 to FIG. 8B. For convenience of explanations, the manufacturing method will be explained below with the leg portion LG11 and the support terminal 401F but the same manufacturing method as that using the leg portion LG11 and the support terminal 401F can be applied to the leg portion LG12 and the support terminal 401B. In addition, the only manufacturing method of the electron emission source 321R will be explained but the same manufacturing method as that of the electron emission source 321L can be applied to the electron emission source 321L.

Figure 6:
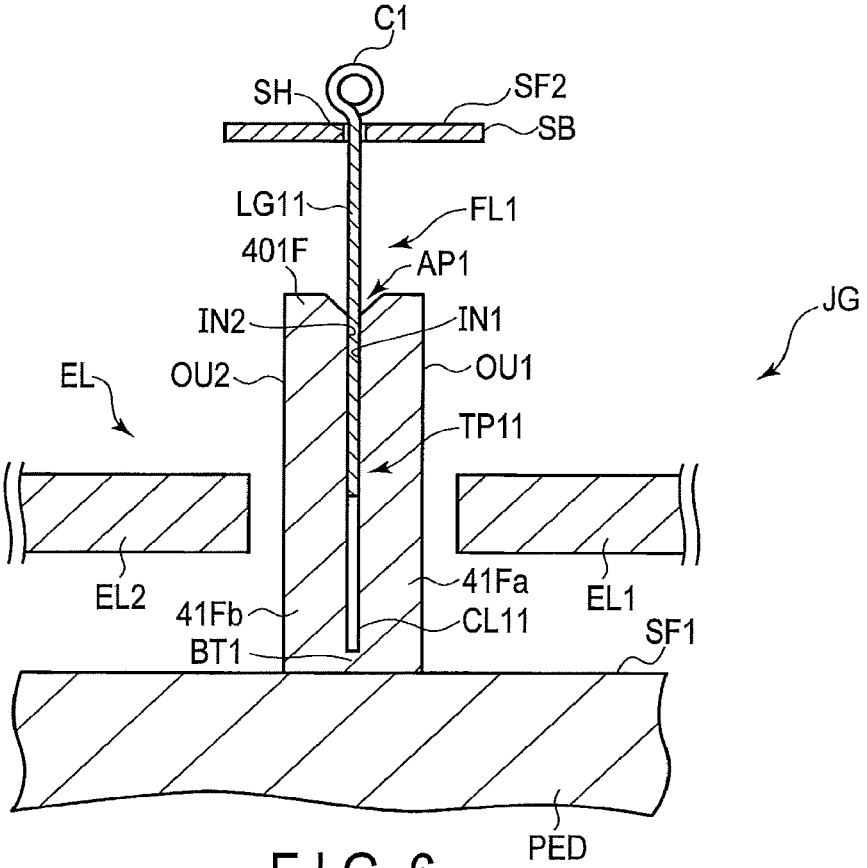
FIG. 6 is a cross-sectional view showing an example of a jig in which the filament and the support terminal are installed.

FIG. 6 is a cross-sectional view showing an example of a jig JG in which the filament FL1 and the support terminal 401F are installed. The jig JG comprises a base PED, an electrode EL, and a support plate SB. A base PED side is called a lower side while a support plate SB side is called an upper side in the following explanations. An object is placed on a surface SF1 of the base PED. The electrode EL is provided at a position separated from the surface SF1 of the base PED in a specific distance to the upper direction. The electrode EL includes at least a pair of electrodes, for example, a pair of electrodes EL1 and EL2. The electrodes EL1 and EL2 are opposed to each other. The electrodes EL1 and EL2 are movable to a direction parallel to the surface SF1 of the base PED. In addition, the electrodes EL1 and EL2 are connected to a positive power source and a negative power source (not shown), respectively. For this reason, the voltage is applied from the power sources and the electrodes EL1 and EL2 are thereby supplied with currents. The support plate SB is formed in a flat plate shape. A through hole SH is formed in the support plate SB. The support plate SB is installed at a position separated from the surface SF1 of the base PED in an arbitrary distance to the upper direction. For example, the support plate SB is installed such that the distal portion TP11 of the leg portion LG11 of the filament FL1 is located between the electrodes EL1 and EL2. The electrodes EL1 and EL2 may be configured to be movable longitudinally to the base PED. In addition, the base PED may be configured to be movable longitudinally, in the jig JG.

As shown in FIG. 6, the support terminal 401F is installed on the surface SF1 of the base PED. The filament FL1 is installed on the support plate SB. When the filament FL1 is installed on the support plate SB, the coil portion C1 is supported on a surface SF2 of the support plate SB. The leg portion LG11 is inserted into the through hole SH of the support plate SB. At this time, the distal portion TP11 of the leg portion LG11 is located between the electrodes EL1 and EL2. For example, the corner portions CP1 and CP2 of the leg portion LG11 are located between the electrodes EL1 and EL2. For example, the distal portion TP11 of the leg portion LG11 is separated from the bottom portion BT1 of the support terminal 401F to the opening portion side. In this case, the distal portion TP11 is separated from the bottom portion BT1 of the bottom portion BT1, and the support terminal 401F and the leg portion LG11 can be therefore crimped efficiently by the electrodes EL1 and EL2.

Figure 7A:
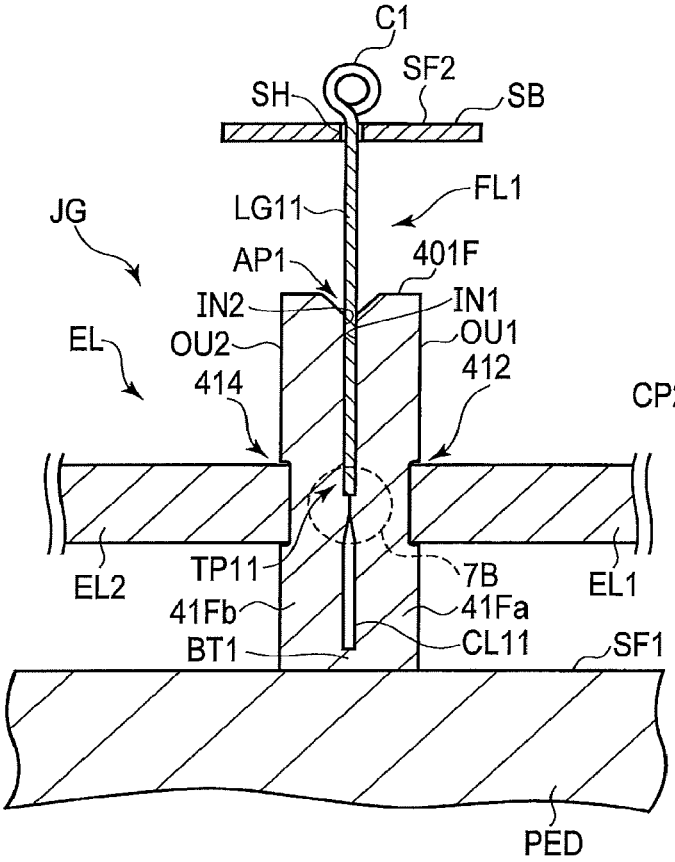
FIG. 7A is a cross-sectional view showing the filament and the support terminal installed in the jig.
Figure 7B:
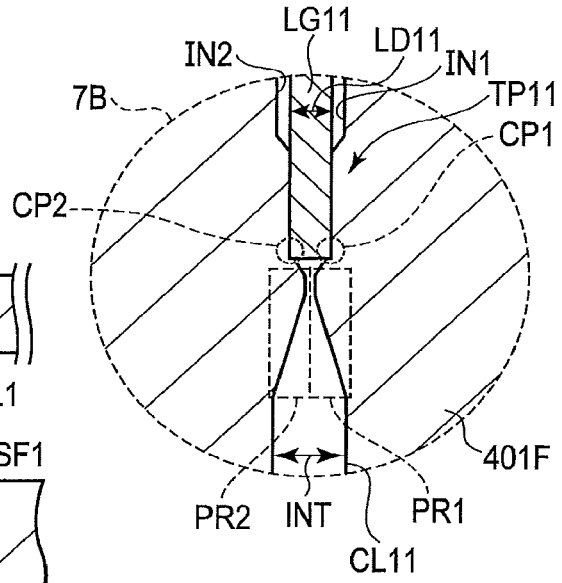
FIG. 7B is an expanded sectional view showing a distal portion of the leg portion.

FIG. 7A and FIG. 7B are cross-sectional views showing an example of the support terminal 401F on which the force is exerted by the electrode EL. FIG. 7A is a cross-sectional view showing the filament FL1 and the support terminal 401F installed in the jig JG. FIG. 7B is an expanded sectional view showing the distal portion TP11 of the leg portion LG11.

As shown in FIG. 7A, the electrodes EL1 and EL2 sandwich the support terminal 401F from both sides to exert force on the outer surfaces OU1 and OU2 of the support terminal 401F. The depressions 412 and 414 are formed on the outer surfaces OU1 and OU2 of the support terminal 401F by the electrodes EL1 and EL2, respectively.

As shown in FIG. 7B, the inner surfaces IN1 and IN2 of the support terminal 401F protrude to the distal portion TP11 of the leg portion LG11 and are made to abut on the corners of the corner portions CP1 and CP2, by the force exerted by the electrodes EL1 and EL2. For this reason, a stress is concentrated on the corner of the corner portion CP1 of the leg portion LG11, and the inner surface IN1 of the support terminal 401F is thereby plastically deformed to cover the corner portion CP1. A stress is concentrated on the corner of the corner portion CP2 of the leg portion LG11, and the inner surface IN2 of the support terminal 401F is thereby plastically deformed to cover the corner portion CP2. The inner surfaces IN1 and IN2 of the support terminal 401F are plastically deformed, and the protruding portions PR1 and PR2 are thereby formed more closely to the bottom portion side than the distal portion TP11 of the leg portion LG11. For this reason, the protruding portions PR1 and PR2 can prevent displacement of the leg portion LG11, for example, displacement to the bottom portion side in the gap CL11, and the like.

Figure 8A:
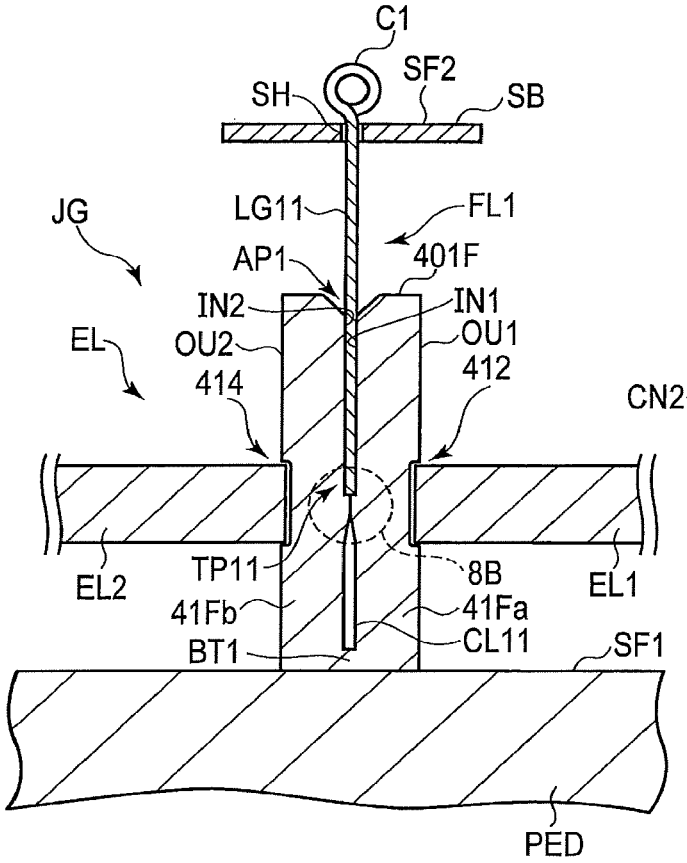
FIG. 8A is a cross-sectional view schematically showing the filament and the support terminal installed in the jig.
Figure 8B:
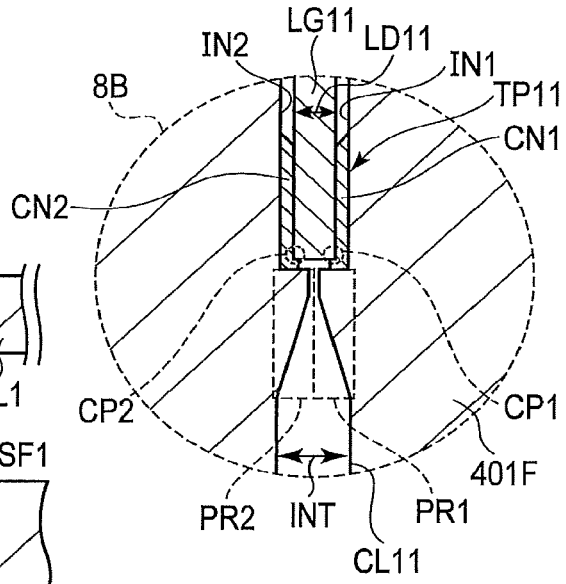
FIG. 8B is an expanded sectional view showing a distal portion of the leg portion.

FIG. 8A and FIG. 8B are cross-sectional views showing the support terminal 401F joined to the distal portion TP11 of the leg portion LG11. FIG. 8A is a cross-sectional view schematically showing the filament FL1 and the support terminal 401F installed in the jig JG. FIG. 8B is an expanded sectional view showing the distal portion TP11 of the leg portion LG11.

In the example illustrated in FIG. 8A, the electrodes EL1 and EL2 supply a current while exerting force on the outer surfaces OU1 and OU2 of the support terminal 401F. At this time, a current having a sufficient current density flows between the inner surfaces IN1 and IN2 and the protruding portions PR1 and PR2 of the support terminal 401F and the corner portions CP1 and CP2 of the leg portion LG11. For this reason, Joule heat sufficient for welding is generated between the corner portion CP1 of the leg portion LG11 and the inner surface IN1 and the protruding portion PR1 of the support terminal 401F. Joule heat sufficient for welding is generated between the corner portion CP2 of the leg portion LG11 and the inner surface IN2 and the protruding portion PR2 of the support terminal 401F. For this reason, the inner surface IN1 and the protruding portion PR1 of the support terminal 401F are molten and joined to the corner portion CP1 to cover the corner portion CP1 of the leg portion LG11. In addition, the inner surface IN2 and the protruding portion PR2 of the support terminal 401F are molten and joined to the corner portion CP2 to cover the corner portion CP2 of the leg portion LG11. For example, as shown in FIG. 8B, the joint portion CN1 is formed between the corner portion CP1 of the leg portion LG11 and the inner surface IN1 and the protruding portion PR1 of the support terminal 401F to cover the corner portion CP1 of the leg portion LG11. The joint portion CN2 is formed between the corner portion CP2 of the leg portion LG11 and the inner surface IN2 and the protruding portion PR2 of the support terminal 401F to cover the corner portion CP2 of the leg portion LG11. The joint portion CN1 is formed by meting at least one of the inner surface IN1 and the protruding portion PR1 of the support terminal 401F and the corner portion CP1 of the leg portion LG11. The joint portion CN2 is formed by meting at least one of the inner surface IN2 and the protruding portion PR2 of the support terminal 401F and the corner portion CP2 of the leg portion LG11. The inner surface IN1 and the protruding portion PR1 of the support terminal 401F are thus joined with a sufficient strength since the inner surface IN1 and the protruding portion PR1 cover the corner portion CP1. The inner surface IN2 and the protruding portion PR2 of the support terminal 401F are thus joined with a sufficient strength since the inner surface IN2 and the protruding portion PR2 cover the corner portion CP2. For this reason, the support terminal 401F can prevent displacement of the leg portion LG11, for example, displacement to the opening portion side in the gap CL11, and the like.

Figure 9:
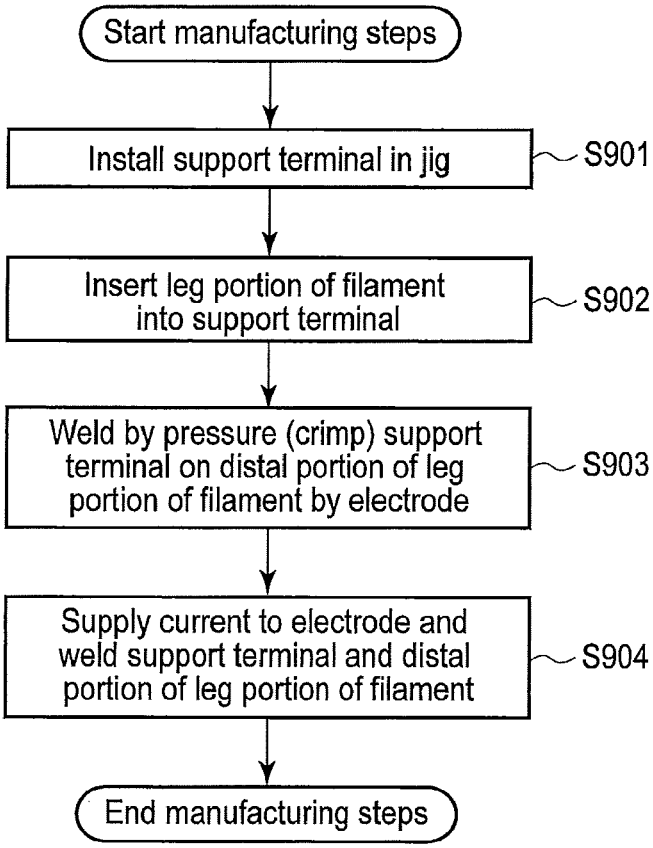
FIG. 9 is a flowchart showing an example of a method of manufacturing an electron emission source of an X-ray tube 1 according to First Embodiment.

FIG. 9 is a flowchart showing an example of a method of manufacturing the electron emission source 321R of the X-ray tube 1 according to the present embodiment.

First, the support terminal 401F is installed in the jig JG (S901). The leg portion LG11 of the filament FL1 is inserted into the gap CL11 of the support terminal 401F (S902). At this time, the distal portion TP11 of the leg portion LG11 is located at a position at which the distal portion can be welded by the electrodes EL1 and EL2.

The support terminal 401F is welded by pressure (crimped) on the distal portion TP11 of the leg portion LG11 by the electrodes EL1 and EL2 (S903). At this time, the inner surface IN1 is made to abut on the corner of the corner portion CP1 of the leg portion LG11 and plastically deformed to cover the corner portion CP1, by the force exerted on the electrodes EL1 and EL2. In addition, the inner surface IN2 is made to abut on a corner of the corner portion CP2 of the leg portion LG11 and plastically deformed to cover the corner portion CP2. At this time, the inner surface IN1 of the support terminal 401F at the protruding portion PR1 protrudes to the inner side of the gap CL11 by the force exerted on the electrodes EL1 and EL2 and is formed more closely to the bottom portion side than the distal portion of the leg portion LG11. The inner surface IN2 of the support terminal 401F at the protruding portion PR2 protrudes to the inner side of the gap CL11 and is formed more closely to the bottom portion side than the distal portion of the leg portion LG11.

In this state, the support terminal 401F is welded on the distal portion TP11 of the leg portion LG11 by the electrodes EL1 and EL2 (S904). At this time, the inner surface IN1 and the protruding portion PR1 of the support terminal 401F are molten and joined to the corner portion CP1 of the leg portion LG11, by the heat generated by the current supplied from the electrodes EL1 and EL2. The inner surface IN2 and the protruding portion PR2 of the support terminal 401F are molten and joined to the corner portion CP2 of the leg portion LG11, by the heat generated by the current supplied from the electrodes EL1 and EL2. The corner portion CP1 of the leg portion LG11 is fixed to the inner surface IN1 and the protruding portion PR1 of the support terminal 401F. The corner portion CP2 of the leg portion LG11 is fixed to the inner surface IN2 and the protruding portion PR2 of the support terminal 401F. The corner of the leg portion LG12 is fixed to the inner surface of the support terminal 401B, similarly to the support terminal 401F and the leg portion LG11. After that, the steps of manufacturing the electron emission source 321R are ended.

In the X-ray tube 1, according to the present embodiment, the corner portions CP1 and CP2 of the leg portion LG11 of the filament FL1 are fixed to the inner surface IN1 and the protruding portion PR1, and the inner surface IN2 and the protruding portion PR2 of the support terminal 401F via the joint portions CN1 and CN2, respectively, in the cathode 31. Since the force exerted on the support terminal 401F by the electrodes EL1 and EL2 is concentrated on the corners of the corner portions CP1 and CP2 of the leg portion LG11, at the manufacturing time, the inner surfaces IN1 and IN2 of the support terminal 401F are plastically deformed at the corners of the corner portions CP1 and CP2 and deformed to cover the corner portions CP1 and CP2. At this time, the inner surfaces IN1 and IN2 are plastically deformed, and the protruding portions PR1 and PR2 are thereby formed. The inner surface IN1 and the protruding portion PR1, and the inner surface IN2 and the protruding portion PR2 of the support terminal 401F are joined to the corner portions CP1 and CP2 with a sufficient strength. For this reason, the X-ray tube 1 can prevent displacement of the leg portions of the filament FL1, for example, the leg portion LG11. As a result, the X-ray tube 1 can prevent contact of the filament FL1 on the cathode cup 310, and the like.

Next, the X-ray tube and the X-ray tube manufacturing method according to modified examples and the other embodiment will be explained. In the modified examples and the other embodiment to be explained below, portions like or similar to those of the above-explained First Embodiment are denoted by the same reference numerals and their detailed explanations are omitted or simplified, and portions different from the First Embodiment will be particularly explained in detail.

Modified Example 1

The X-ray tube 1 according to Modified Example 1 of the First Embodiment is different from the X-ray tube 1 according to the First Embodiment with respect to a feature that in the electron emission source, for example, the electron emission source 321R, the corner portions CP1 and CP2 of the leg portion LG11 are located outside the range sandwiched between the depressions 412 and 414 in the gap CL11.

Figure 10A:
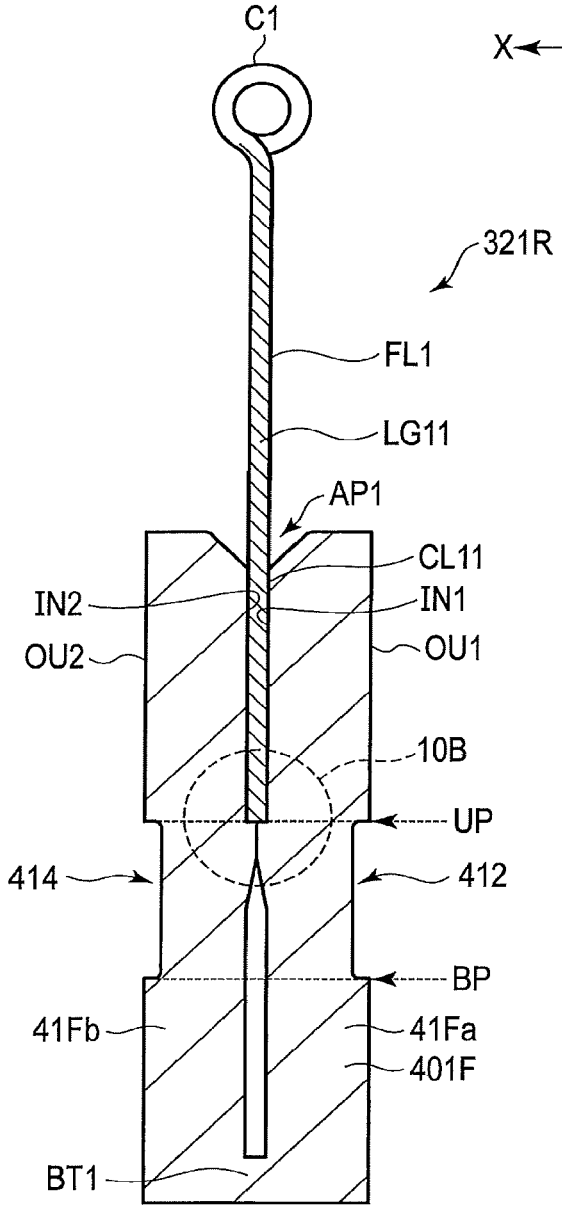
FIG. 10A is an expanded sectional view showing an example of the electron emission source of the X-ray tube according to Modified Example 1.
Figure 10B:
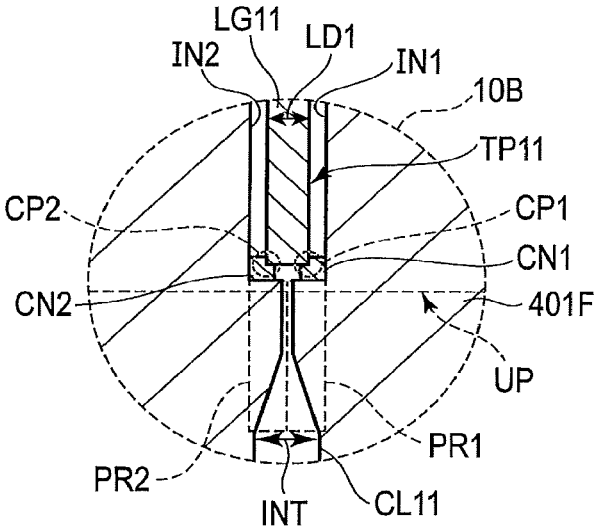
FIG. 10B is an expanded sectional view showing an example of a distal portion of the leg portion.

FIG. 10A and FIG. 10B are cross-sectional views showing an example of a structure of the electron emission source 321R of the X-ray tube 1 according to Modified Example 1 of the First Embodiment. In FIG. 10A and FIG. 10B, a boundary position on the opening portion side is called position UP while a boundary position on the bottom portion side is called position BP, in the range sandwiched between the depressions 412 and 414. FIG. 10A is an expanded sectional view showing an example of the electron emission source 321R. FIG. 10B is an expanded sectional view showing an example of the distal portion TP11 of the leg portion LG11.

The distal portion TP11 of the leg portion LG11 is located more closely to the opening portion side than the range sandwiched between the electrodes (i.e., the range sandwiched between the depressions 412 and 414), in the support terminal 401F. In the example illustrated in FIG. 10A, the distal portion TP11 of the leg portion LG11 is located near the position UP, in the gap CL11.

In the example illustrated in FIG. 10B, the corner portions CP1 and CP2 of the leg portion LG11 are located more closely to the opening portion side than the range sandwiched between the depressions 412 and 414. For example, the corner portions CP1 and CP2 of the leg portion LG11 are located more closely to the opening portion side than the position UP. The protruding portions PR1 and PR2 are formed to be longer than the protruding portions PR1 and PR2 shown in FIG. 4, respectively. In this case, too, a current is supplied with a sufficient current density, and the inner surface IN and the protruding portion PR of the support terminal 401F are thereby joined to the corner portion CP1 of the leg portion LG11 with a sufficient strength. In addition, the inner surface IN2 and the protruding portion PR2 of the support terminal 401F are also joined to the corner portion CP2 of the leg portion LG12 with a sufficient strength.

Figure 11A:
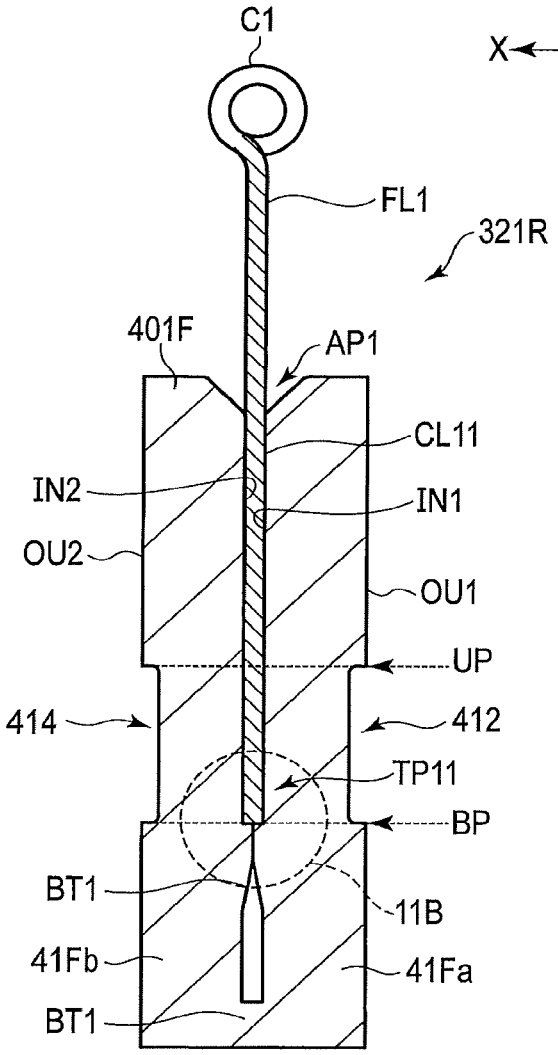
FIG. 11A is an expanded sectional view showing an example of the electron emission source of the X-ray tube according to Modified Example 1.
Figure 11B:
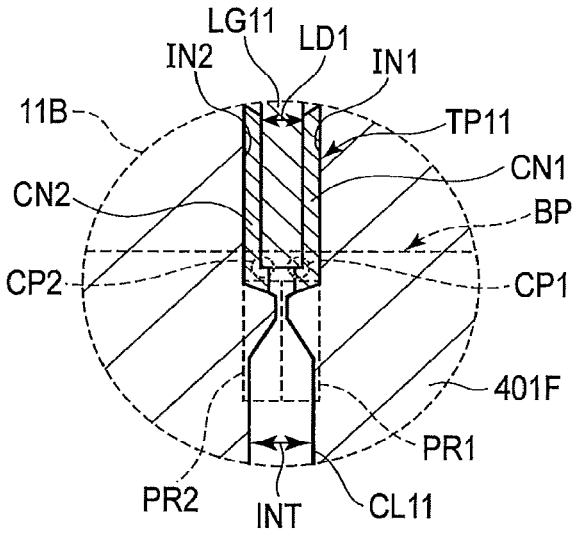
FIG. 11B is an expanded sectional view showing an example of the distal portion of the leg portion.

FIG. 11A and FIG. 11B are cross-sectional views showing an example of the structure of the electron emission source 321R of the X-ray tube 1 according to Modified Example 1 of the First Embodiment. In FIG. 11A and FIG. 11B, a boundary position on the opening portion side is called position UP while a boundary position on the bottom portion side is called position BP, in the range sandwiched between the depressions 412 and 414. FIG. 11A is an expanded sectional view showing an example of the electron emission source 321R. FIG. 11B is an expanded sectional view showing an example of the distal portion TP11 of the leg portion LG11.

The distal portion TP11 of the leg portion LG11 is located more closely to the bottom portion side than the range sandwiched between the depressions 412 and 414. In the example illustrated in FIG. 11A, the distal portion TP11 of the leg portion LG11 is located near the position BP, in the gap CL11.

In the example illustrated in FIG. 11B, the corner portions CP1 and CP2 of the leg portion LG11 are partially located more closely to the bottom portion side than the range sandwiched between the depressions 412 and 414. For example, the corner portions CP1 and CP2 of the leg portion LG11 are partially located more closely to the bottom portion side than the position BP. The protruding portions PR1 and PR2 are formed to be shorter than the protruding portions PR1 and PR2 shown in FIG. 4, respectively. In this case, too, a current is supplied with a sufficient current density, and the inner surface IN and the protruding portion PR of the support terminal 401F are thereby joined to the corner portion CP1 of the leg portion LG11 with a sufficient strength. In addition, the inner surface IN2 and the protruding portion PR2 of the support terminal 401F are also joined to the corner portion CP2 of the leg portion LG12 with a sufficient strength.

In the X-ray tube 1 according to Modified Example 1, the corner portions CP1 and CP2 of the leg portion LG11 of the filament FL1 of the electron emission source, for example, the electron emission source 321R, are located outside the range sandwiched between the depressions 412 and 414, in the gap CL11. In this case, too, a current is supplied with a sufficient current density, and the inner surface IN1 and the protruding portion PR1 of the support terminal 401F are thereby joined to the corner portion CP1 of the leg portion LG11 with a sufficient strength. In addition, the inner surface IN2 and the protruding portion PR2 of the support terminal 401F are also joined to the corner portion CP2 of the leg portion LG12 with a sufficient strength. For this reason, the X-ray tube 1 can prevent displacement of the leg portions of the filament FL1, for example, the leg portion LG11.

Modified Example 2

The X-ray tube 1 according to Modified Example 2 of the First Embodiment is different from the above-explained X-ray tube 1 with respect to a feature that in the electron emission source, for example, the electron emission source 321R, the protruding portions PR1 and PR2 of the support terminal 401F are joined to each other.

Figure 12A:
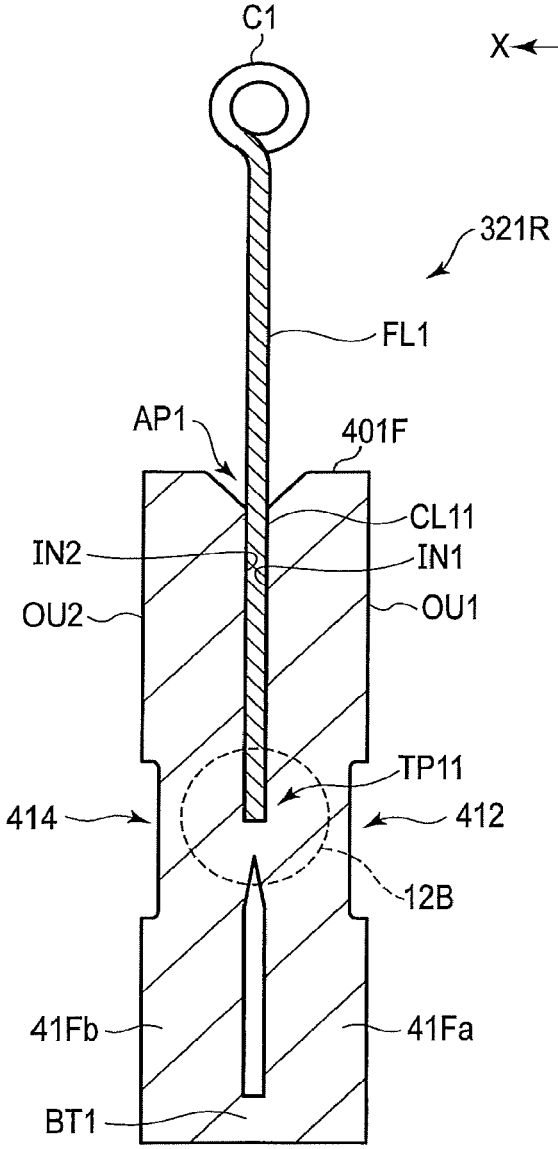
FIG. 12A is an expanded sectional view showing an example of the electron emission source of the X-ray tube according to Modified Example 2.
Figure 12B:
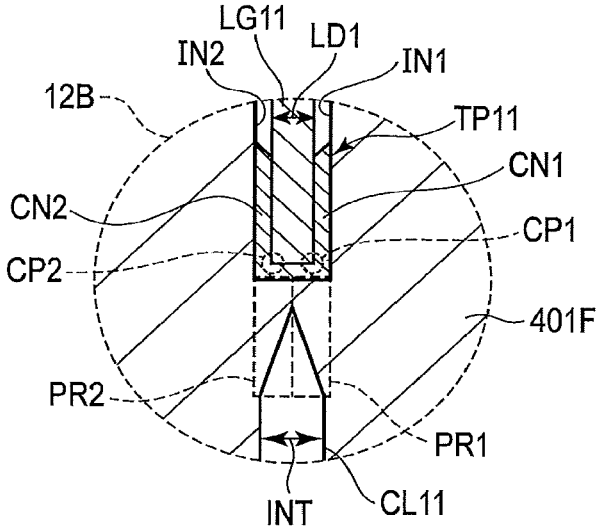
FIG. 12B is an expanded sectional view showing an example of the distal portion of the leg portion.

FIG. 12A and FIG. 12B are cross-sectional views showing an example of the structure of the electron emission source 321R of the X-ray tube 1 according to Modified Example 2 of the First Embodiment. FIG. 12A is an expanded sectional view showing an example of the electron emission source 321R. FIG. 12B is an expanded sectional view showing an example of the distal portion TP11 of the leg portion LG11.

In the example illustrated in FIG. 12A, the distal portion TP11 of the leg portion LG11 is located between the depressions 412 and 414, in the gap CL11. In the example illustrated in FIG. 12B, the protruding portions PR1 and PR2 of the support terminal 401F are joined to each other. In addition, the protruding portions PR1 and PR2 are joined at a position between the bottom surface of the leg portion LG11 and the protruding portions PR1 and PR2. The leg portion LG11 is larger than the leg portion LG11 of the above-explained embodiment with respect to the range in which the protruding portions PR1 and PR2 are joined. The leg portion LG11, and the inner surfaces IN1 and IN2 and the protruding portions PR1 and PR2 are joined via the joint portions CN1 and CN2, with a sufficient strength.

In the X-ray tube 1 according to Modified Example 2, the protruding portions PR1 and PR2 of the support terminal 401F are joined to each other. The corner portion CP1 of the leg portion LG11 is joined to the protruding portion PR1 and the inner surface IN1 via the joint portion CN1. The corner portion CP2 of the leg portion LG11 is joined to the protruding portion PR1 and the inner surface IN2 via the joint portion CN2. The joint portions CN1 and CN2 are joined at a position between the bottom surface of the leg portion LG11 and the protruding portions PR1 and PR2. For this reason, the leg portion LG11, and the inner surfaces IN1 and IN2 and the protruding portions PR1 and PR2 are joined via the joint portions CN1 and CN2, with a sufficient strength. For this reason, the X-ray tube 1 can prevent displacement of the leg portions of the filament FL1, for example, the leg portion LG11.

Modified Example 3

The X-ray tube 1 according to Modified Example 3 of the First Embodiment is different from the above-explained X-ray tube 1 with respect to a feature that in the electron emission source, for example, the electron emission source 321R, the outer surfaces OU1 and OU2 of the support terminal 401F are formed in a planar shape.

Figure 13A:
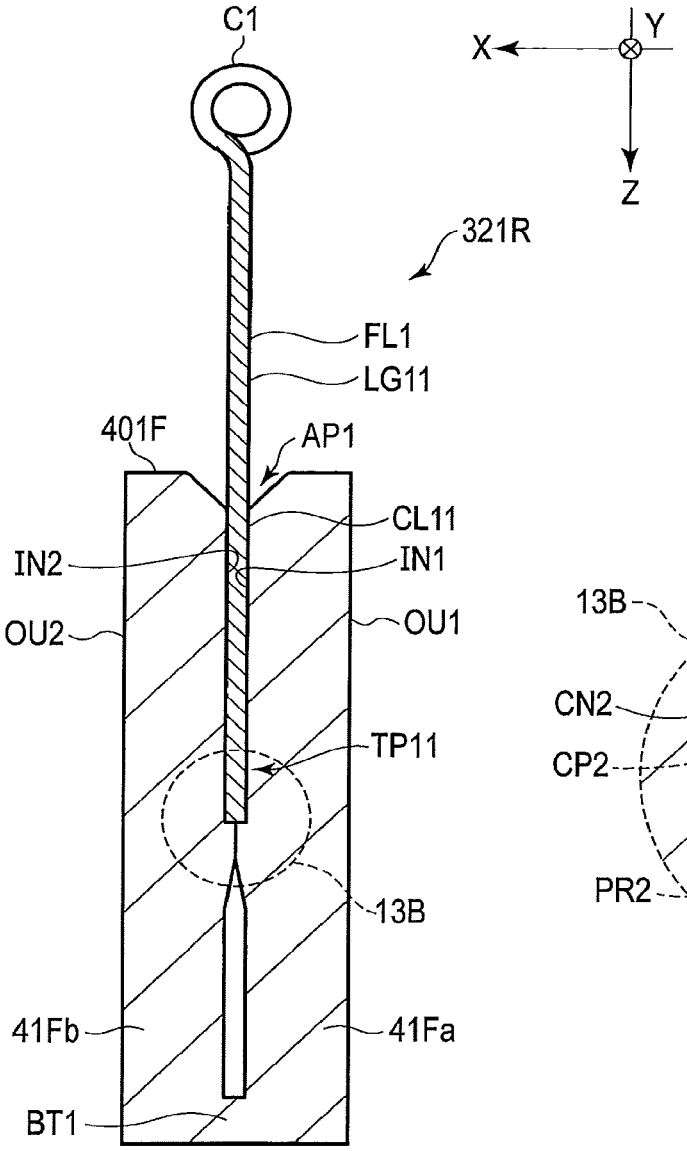
FIG. 13A is an expanded sectional view showing an example of the electron emission source of the X-ray tube according to Modified Example 3.
Figure 13B:
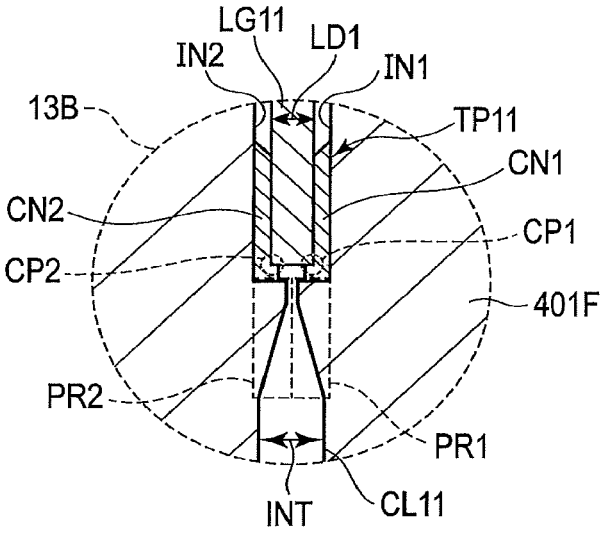
FIG. 13B is an expanded sectional view showing an example of the distal portion of the leg portion.

FIG. 13A and FIG. 13B are cross-sectional views showing an example of the structure of the electron emission source 321R of the X-ray tube 1 according to Modified Example 3 of the First Embodiment. FIG. 13A is an expanded sectional view showing an example of the electron emission source 321R. FIG. 13B is an expanded sectional view showing an example of the distal portion TP11 of the leg portion LG11.

In the example illustrated in FIG. 13A, the outer surfaces OU1 and OU2 of the support terminal 401F are formed in a planar shape. In the example illustrated in FIG. 13B, the corner portion CP1 of the leg portion LG11 is fixed to the protruding portion PR1 and the inner surface IN1 of the support terminal 401F via the joint portion CN1. In addition, the corner portion CP2 of the leg portion LG11 is fixed to the protruding portion PR2 and the inner surface IN2 of the support terminal 401F via the joint portion CN2.

In the X-ray tube 1 according to Modified Example 3, the outer surface of the support terminal 401F is formed in a planar shape. In this case, too, a current is supplied with a sufficient current density, and the inner surface IN2 and the protruding portion PR2 of the support terminal 401F are thereby joined to the corner portion CP1 of the leg portion LG11 with a sufficient strength. In addition, the inner surface IN2 and the protruding portion PR2 of the support terminal 401F are also joined to the corner portion CP2 of the leg portion LG12 with a sufficient strength. For this reason, the X-ray tube 1 can prevent displacement of the leg portions of the filament FL1, for example, the leg portion LG11.

Modified Example 4

The X-ray tube 1 according to Modified Example 4 of the First Embodiment is different from the above-explained X-ray tube 1 with respect to an orientation of the support terminal 401F in the electron emission source, for example, the electron emission source 321R.

Figure 14:
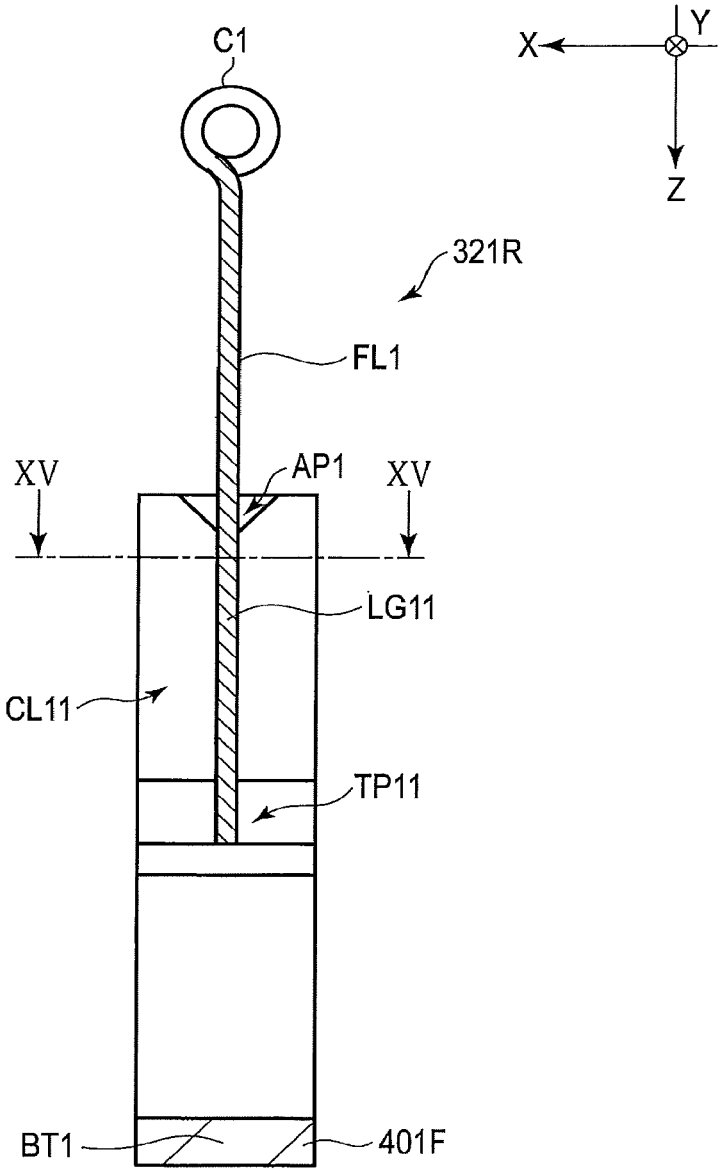
FIG. 14 is an expanded sectional view showing an example of a structure of the electron emission source of the X-ray tube according to Modified Example 4.

FIG. 14 is a cross-sectional view showing an example of a structure of the electron emission source 321R of the X-ray tube 1 according to Modified Example 4 of the First Embodiment. FIG. 14 shows an example of a section of the electron emission source 321R when seeing the X-Z plane from the second direction Y. In the example illustrated in FIG. 14, the gap CL11 of the support terminal 401F is provided horizontally in the X-Z plane. In other words, the gap CL11 is provided vertically to a plane horizontal to the filament FL1, of the support terminal 401F. For example, the support terminal 401F shown in FIG. 14 is provided by rotating the support terminal 401F shown in FIG. 4 around an axis extending in the third direction Z at ninety degrees. The support terminal 401F shown in FIG. 14 may be provided by rotating the support terminal 401F shown in FIG. 4 around an axis extending in the second direction Y at an angle other than ninety degrees.

Figure 15A:
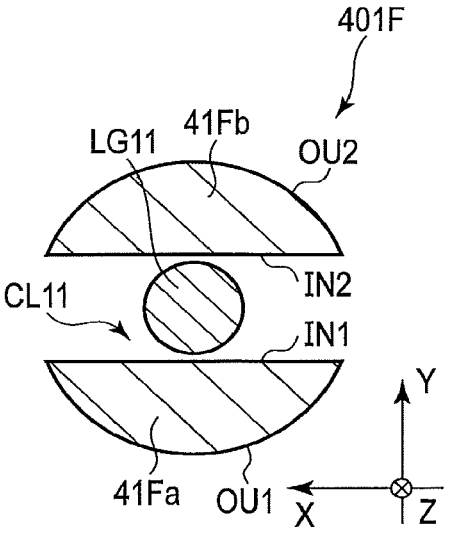
FIG. 15A is a cross-sectional view showing an example of a support terminal in which each of sections of a first terminal portion and a second terminal portion is formed in a rectangular shape.
Figure 15B:
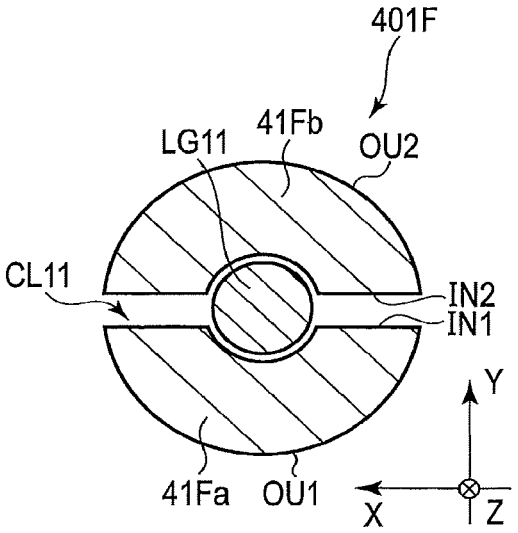
FIG. 15B is a cross-sectional view showing an example of a support terminal in which each of parts of the sections of the first terminal portion and the second terminal portion is formed along a shape of a leg portion.

FIG. 15A and FIG. 15B are cross-sectional views showing several examples of the partial structure of the support terminal 401F cut along XV-XV shown in FIG. 14. FIG. 15A and FIG. 15B show several examples of a section of the support terminal 401F when seeing the X-Y plane from the third direction Z. FIG. 15A is a cross-sectional view showing an example of the support terminal 401F in which each of sections of the first terminal portion 41Fa and the second terminal portion 41Fb is formed in a semicircular shape. FIG. 15B is a cross-sectional view showing an example of the support terminal 401F in which each of sections of the first terminal portion 41Fa and the second terminal portion 41Fb is formed in a fan shape.

The section of the support terminal 401F shown in FIG. 15A indicates the structure obtained by rotating the section of the support terminal 401F shown in FIG. 5A around an axis extending in the third direction Z at ninety degrees. The section of the support terminal 401F shown in FIG. 15B indicates the structure obtained by rotating the section of the support terminal 401F shown in FIG. 5B around an axis extending in the second direction Y at ninety degrees. The sectional shape of the support terminal 401F shown in FIG. 15A and FIG. 15B is a mere example and may be a sectional shape other than this. For example, the section of the support terminal 401F may be formed in a rectangular shape.

In the X-ray tube 1 according to Modified Example 4, the gap CL11 is formed vertically to the plane horizontal to the filament FL1, in the support terminal 401F. For this reason, the support terminal 401F can prevent displacement of the leg portion LG11 to a direction horizontal to the plane horizontal to the filament FL1, for example, the second direction Y.

Modified Example 5

The X-ray tube 1 according to Modified Example 5 of the First Embodiment is different from the above-explained X-ray tube 1 with respect to a feature of comprising a middle member IM between the leg portion LG11 of the filament FL1 and the inner surface of the support terminal 401F, in the electron emission source, for example, the electron emission source 321R.

Figure 16A:
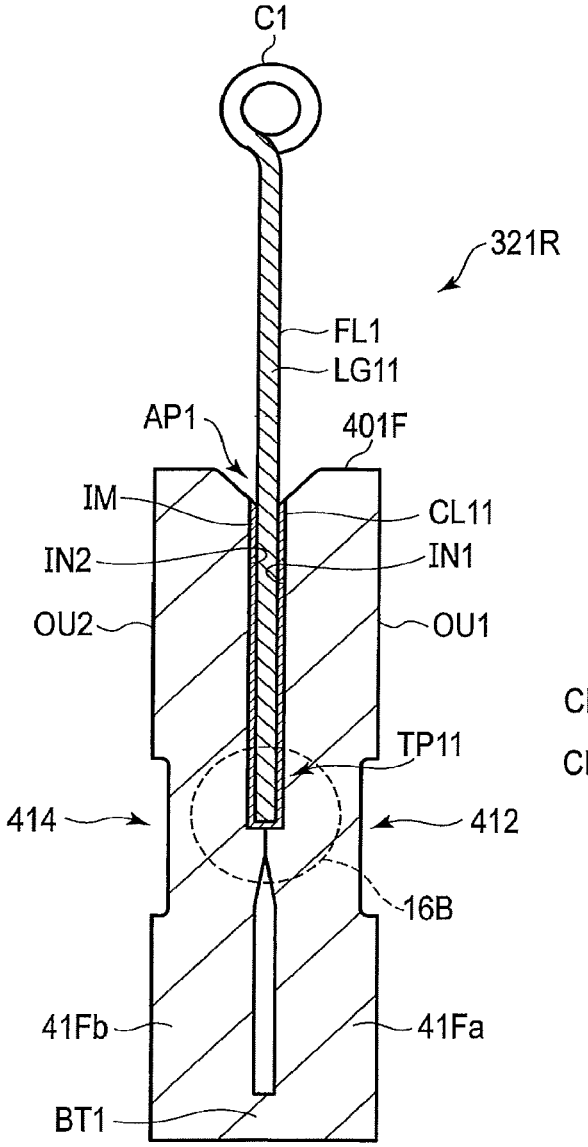
FIG. 16A is an expanded sectional view showing an example of the electron emission source of the X-ray tube according to Modified Example 5.
Figure 16B:
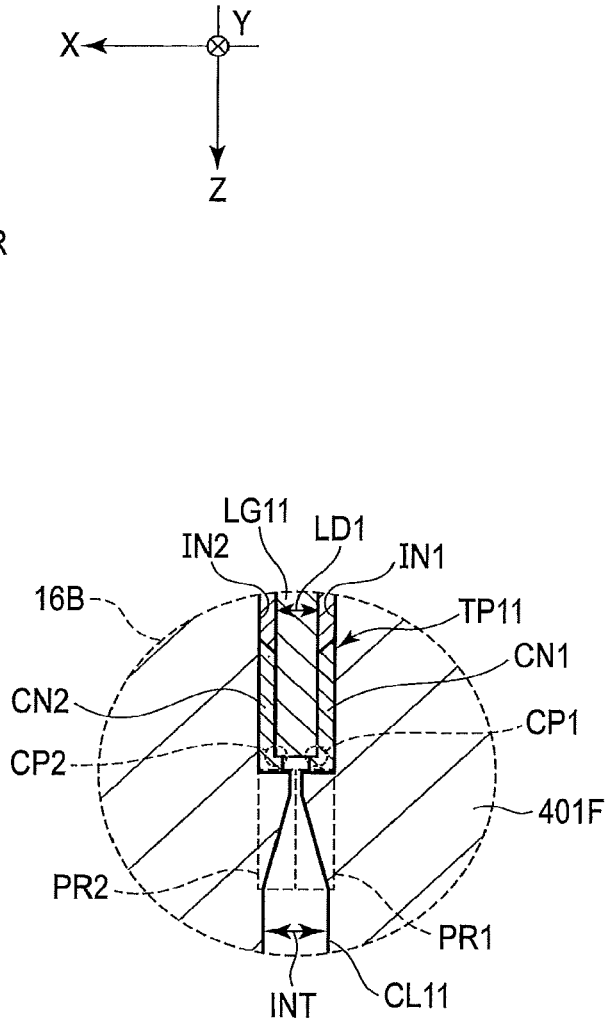
FIG. 16B is an expanded sectional view showing an example of the distal portion of the leg portion.

FIG. 16A and FIG. 16B are cross-sectional views showing an example of a structure of the electron emission source 321R of the X-ray tube 1 according to Modified Example 5 of the First Embodiment. FIG. 16A is an expanded sectional view showing an example of the electron emission source 321R. FIG. 16B is an expanded sectional view showing an example of the distal portion TP11 of the leg portion LG11.

In the example illustrated in FIG. 16A, the electron emission source 321R comprises the middle member IM between the leg portion LG11 of the filament FL1 and the inner surface of the support terminal 401F. The support terminal 401F is formed of, for example, molybdenum or an alloy containing molybdenum as a main component. The middle member IM is formed of, for example, platinum or an alloy containing platinum as a main component. The middle member IM is formed of, for example, foil or plating.

In the example illustrated in FIG. 16B, the corner portion CP1 of the leg portion LG11 is fixed to the protruding portion PR1 and the inner surface IN1 via the joint portion CN1. The corner portion CP2 of the leg portion LG11 is joined to the protruding portion PR2 and the inner surface IN2 via the joint portion CN2. For example, the joint portion CN1 is formed by melting at least one of the corner portion CP1 of the leg portion LG11, the inner surface IN1 (and the protruding portion PR1) of the support terminal 401F, and the middle member IM. The joint portion CN2 is formed by melting at least one of the corner portion CP2 of the leg portion LG11, the inner surface IN2 (and the protruding portion PR2) of the support terminal 401F, and the middle member IM. In the example illustrated in FIG. 16B, the middle member IM is provided more closely to the opening portion side than the joint portions CN1 and CN2, in the gap CL11 between the inner surface of the support terminal 401F and the leg portion LG11. The middle member IM may be included in the joint portions CN1 and CN2. For this reason, as shown in FIG. 16B, for example, the middle member IM may not be provided more closely to the opening portion side than the joint portions CN1 and CN2, in the gap CL11 between the inner surface of the support terminal 401F and the leg portion LG11.

An example of a method of manufacturing the electron emission source 321R according to Modified Example 5 will be hereinafter explained with reference to FIG. 17 to FIG. 19B.

Figure 17:
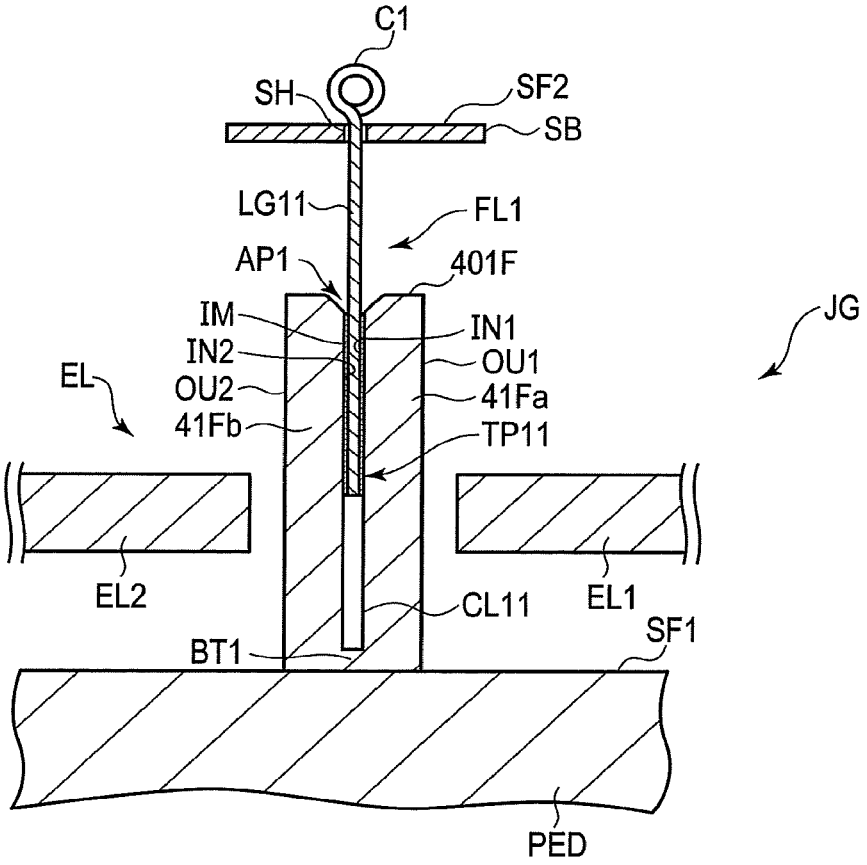
FIG. 17 is a cross-sectional view showing an example of a jig in which the filament and the support terminal are installed.

FIG. 17 is a cross-sectional view showing an example of the jig JG in which the filament FL1 and the support terminal 401F are installed.

As shown in FIG. 17, the support terminal 401F is installed on the surface SF1 of the base PED. At this time, the leg portion LG11 comprises at least the middle member IM at the distal portion TP11. The distal portion TP11 of the leg portion LG11 is located between the electrodes EL1 and EL2.

Figure 18A:
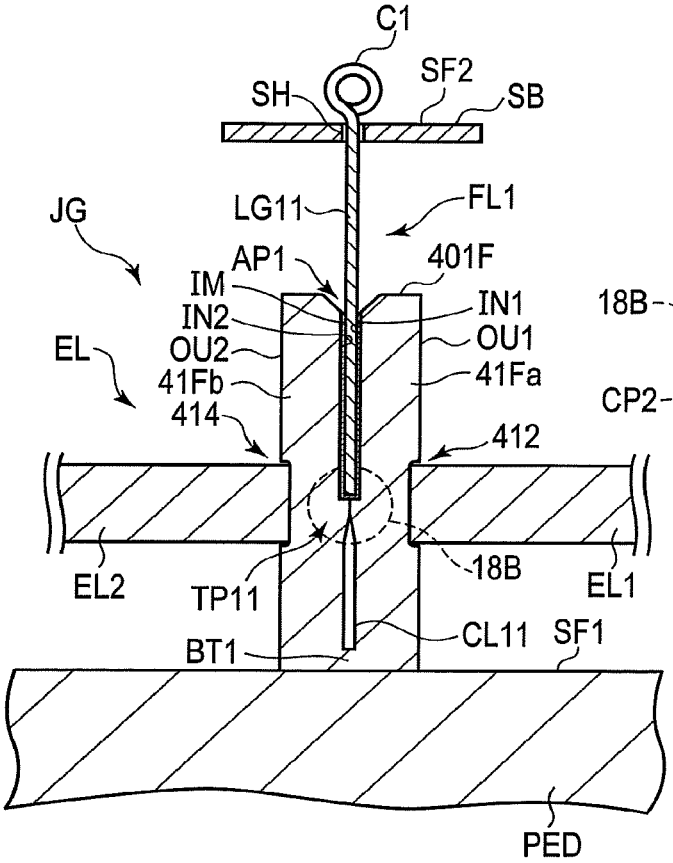
FIG. 18A is a cross-sectional view showing the filament and the support terminal installed in the jig.
Figure 18B:
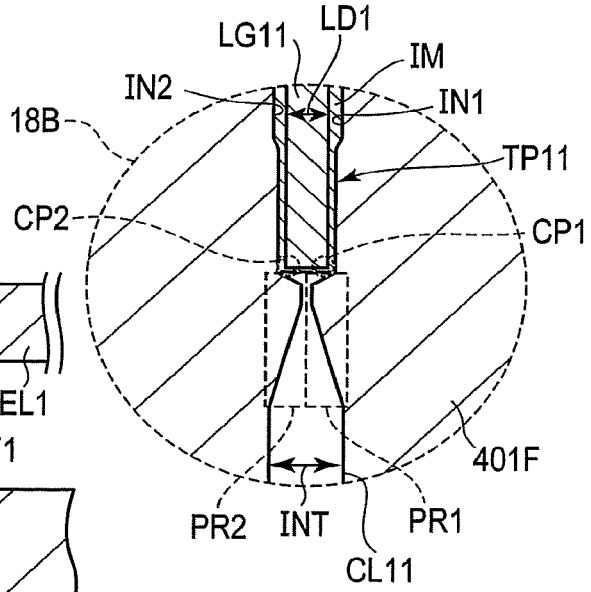
FIG. 18B is an expanded sectional view showing a distal portion of the leg portion.

FIG. 18A and FIG. 18B are cross-sectional views showing an example of the support terminal 401F on which the force is exerted by the electrode EL. FIG. 18A is a cross-sectional view showing the filament FL1 and the support terminal 401F installed in the jig JG. FIG. 18B is an expanded sectional view showing the distal portion TP11 of the leg portion LG11.

As shown in FIG. 18A, the electrodes EL1 and EL2 sandwich the support terminal 401F from both sides to exert force on the outer surfaces OU1 and OU2 of the support terminal 401F. The depressions 412 and 414 are formed on the outer surfaces OU1 and OU2 of the support terminal 401F by the electrodes EL1 and EL2, respectively.

As shown in FIG. 18B, the inner surfaces IN1 and IN2 of the support terminal 401F protrude to the distal portion TP11 of the leg portion LG11 and are made to abut on the corners of the corner portions CP1 and CP2, by the force exerted by the electrodes EL1 and EL2. For this reason, a stress is concentrated on the corner of the corner portion CP1 of the leg portion LG11, and the inner surface IN1 of the support terminal 401F is thereby plastically deformed to cover the corner portion CP1. A stress is concentrated on the corner of the corner portion CP2 of the leg portion LG11, and the inner surface IN2 of the support terminal 401F is thereby plastically deformed to cover the corner portion CP2.

Figure 19A:
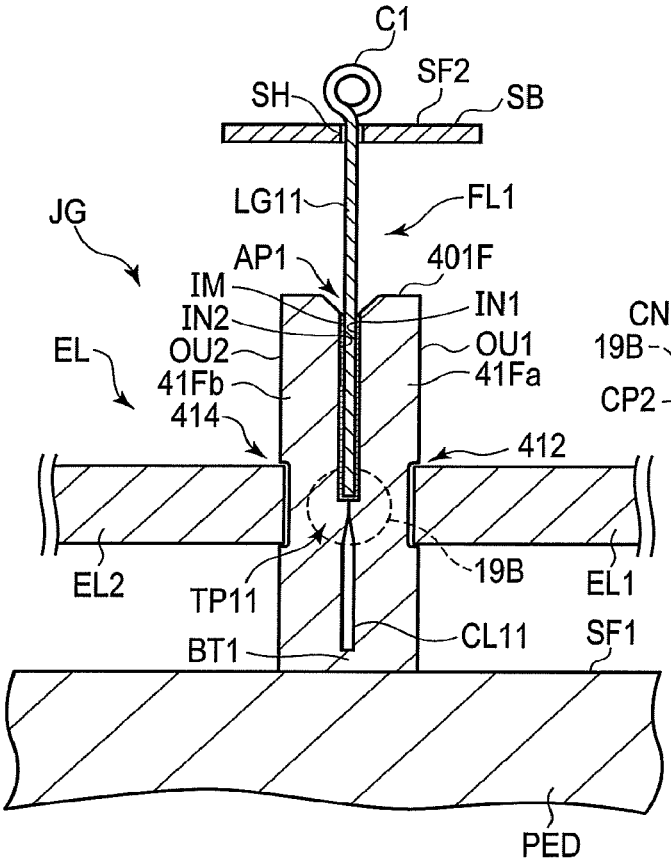
FIG. 19A is a cross-sectional view schematically showing the filament and the support terminal installed in the jig.
Figure 19B:
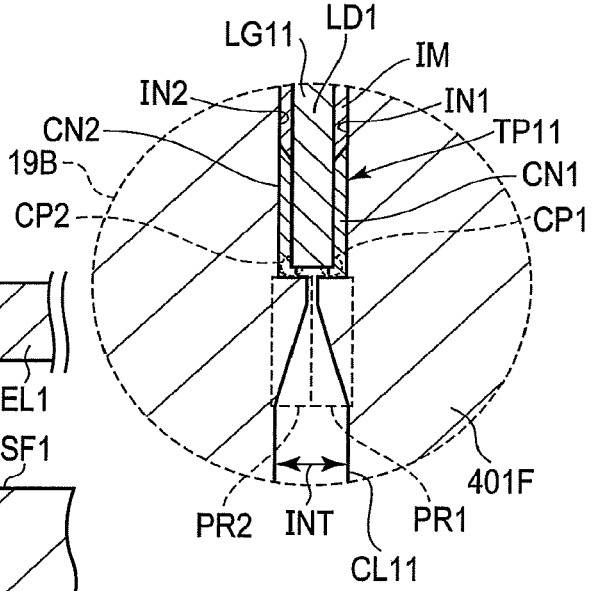
FIG. 19B is an expanded sectional view showing a distal portion of the leg portion.

FIG. 19A and FIG. 19B are cross-sectional views showing the support terminal 401F joined to the leg portion LG11 of the filament FL1. FIG. 19A is a cross-sectional view schematically showing the filament FL1 and the support terminal 401F installed in the jig JG. FIG. 19B is an expanded sectional view showing the distal portion TP11 of the leg portion LG11.

In the example illustrated in FIG. 19A, the inner surface IN1 and the protruding portion PR1 of the support terminal 401F are molten and joined to the corner portion CP1 to cover the corner portion CP1 of the leg portion LG11 via the middle member IM. In addition, the inner surface IN2 and the protruding portion PR2 of the support terminal 401F are molten and joined to the corner portion CP2 to cover the corner portion CP2 of the leg portion LG11 via the middle member IM. For example, as shown in FIG. 19B, the joint portion CN1 is formed between the corner portion CP1 of the leg portion LG11 and the inner surface IN1 and the protruding portion PR1 of the support terminal 401F to cover the corner portion CP1 of the leg portion LG11. The joint portion CN2 is formed between the corner portion CP2 of the leg portion LG11 and the inner surface IN2 and the protruding portion PR2 of the support terminal 401F to cover the corner portion CP2 of the leg portion LG11. The joint portion CN1 is formed by meting at least one of the inner surface IN1 and the protruding portion PR1 of the support terminal 401F, the corner portion CP1 of the leg portion LG11, and the middle member IM. The joint portion CN2 is formed by meting at least one of the inner surface IN2 and the protruding portion PR2 of the support terminal 401F, the corner portion CP2 of the leg portion LG11, and the middle member IM. Thus, performance of welding between the leg portion LG11 of the filament FL1 and the support terminal 401F is improved by providing the middle member IM between the leg portion LG11 and the inner surface of the support terminal 401F.

According to Modified Example 5, the X-ray tube 1 comprises the middle member IM between the leg portion LG11 and the inner surface of the support terminal 401F, in the electron emission source, for example, the electron emission source 321R. For this reason, performance of welding between the leg portion LG11 and the inner surface of the support terminal 401F, in the X-ray tube 1, is improved at the manufacturing time.

Modified Example 6

The X-ray tube 1 according to Modified Example 6 of the First Embodiment is different from the above-explained X-ray tube 1 with respect to a sectional shape of the support terminal 401F in the electron emission source, for example, the electron emission source 321R.

Figure 20:
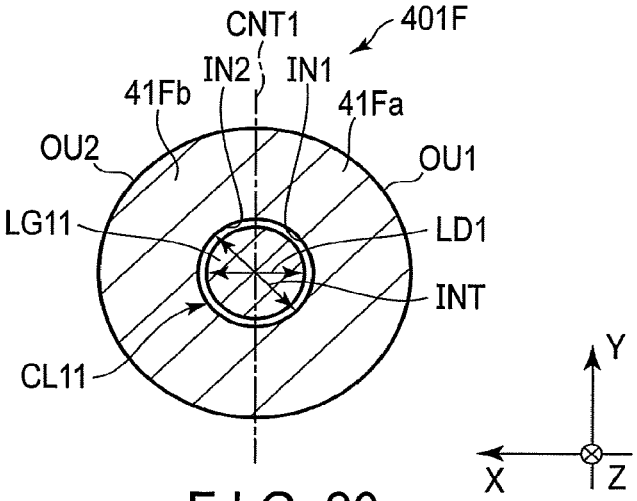
FIG. 20 is an expanded sectional view showing an example of a partial structure of the support terminal of the X-ray tube according to Modified Example 6.

FIG. 20 is an expanded sectional view showing an example of a partial structure of the support terminal 401F of the X-ray tube 1 according to Modified Example 6 of the First Embodiment. FIG. 20 shows an example of the section of the support terminal 401F when seeing the X-Y plane from the third direction Z. A center CNT1 of the center of width in the first direction X of the section of the support terminal 401F is shown in FIG. 20. In FIG. 20, one of portions of the support terminal 401F based on the center CNT1 is called a first terminal portion 41Fa and the other portion is called a second terminal portion 41Fb. In the example illustrated in FIG. 20, a circular gap CL11 is formed in the section of the support terminal 401F. In the section of the support terminal 401F shown in FIG. 20, the gap CL11 does not extend up to the outside. The section of the support terminal 401F shown in FIG. 20 is a mere example and may be a section other than this.

In the X-ray tube 1 according to Modified Example 6, the circular gap CL11 is formed in the section of the support terminal 401F. For this reason, the X-ray tube 1 can prevent displacement of the leg portions of the filament FL1, for example, the leg portion LG11.

Second Embodiment

An X-ray tube 1 according to Second Embodiment is different from the above-explained X-ray tube 1 with respect to a feature that a leg portion LG11 of a filament FL1 is joined to a support terminal 401F at a plurality of parts in an electron emission source, for example, an electron emission source 321R.

Figure 21A:
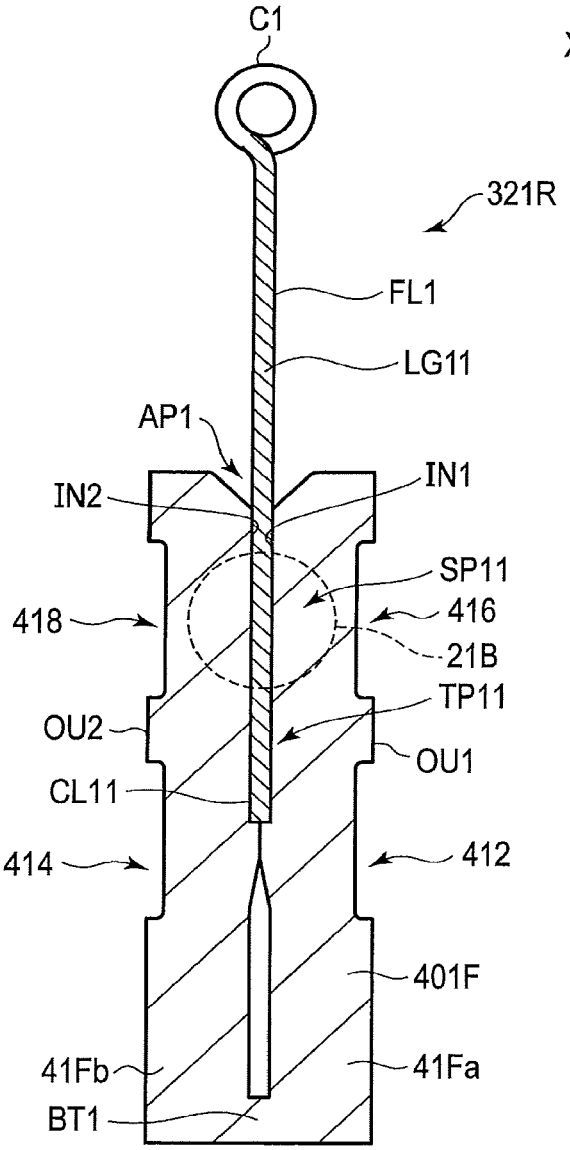
FIG. 21A is an expanded sectional view showing an example of an electron emission source.
Figure 21B:
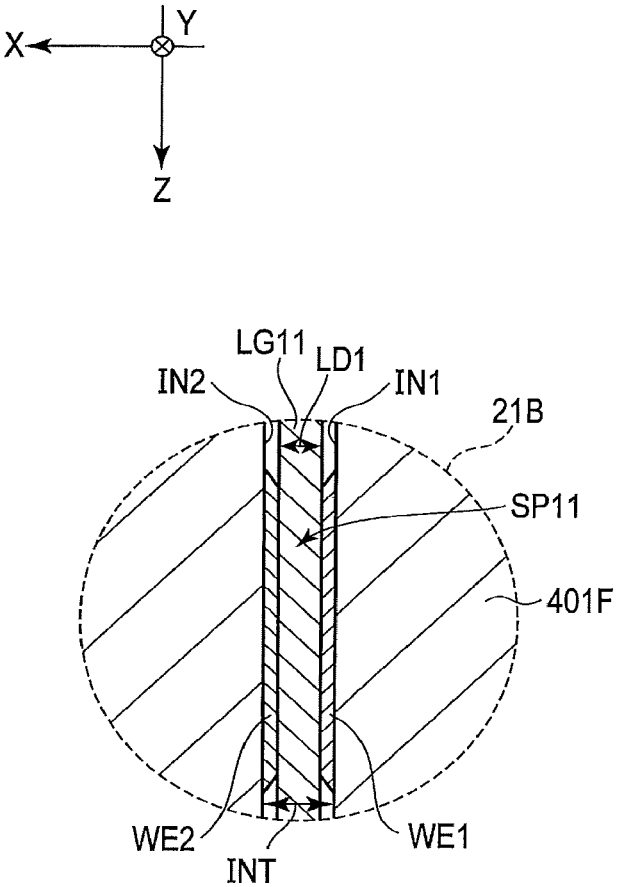
FIG. 21B is an expanded sectional view showing an example of the distal portion of the leg portion.

FIG. 21A and FIG. 21B are cross-sectional views showing an example of a structure of the electron emission source 321R according to the Second Embodiment. FIG. 21A is an expanded sectional view showing an example of the electron emission source 321R. FIG. 21B is an expanded sectional view showing an example of a distal portion TP11 of the leg portion LG11.

In the example illustrated in FIG. 21A, the support terminal 401F comprises a pair of depressions 412 and 414 and a pair of depressions 416 and 418. The depressions 416 and 418 are formed on outer surfaces OU1 and OU2 of the support terminal 401F, respectively. The depression 416 is formed more closely to the outer surface OU1 on the opening portion side than the depression 412. The depression 418 is formed more closely to the outer surface OU2 on the opening portion side than the depression 414. The depression 416 is opposed to the depression 418 with the gap CL11 sandwiched between the depressions. In the example illustrated in FIG. 21A, a support portion SP11 of the leg portion LG11 is located between the depressions 416 and 418, in the gap CL11. In the leg portion LG11, the support portion SP11 is located more closely to the coil portion C1 side than the distal portion TP11.

In the example illustrated in FIG. 21B, the support portion SP11 of the leg portion LG11 is fixed to the inner surface IN1 via a joint portion WE1 and fixed to the inner surface IN2 via a joint portion WE2. The joint portion WE1 is formed by melting at least one of the support portion SP11 of the leg portion LG11 and the inner surface IN1 of the support terminal 401F. The joint portion WE2 is formed by melting at least one of the support portion SP11 of the leg portion LG11 and the inner surface IN2 of the support terminal 401F. Each of the joint portions WE1 and WE2 is formed of a conductive metallic member. The joint portion WE1 may be formed integrally with at least one of the support portion SP11 of the leg portion LG11 and the inner surface IN1 of the support terminal 401F. The joint portion WE2 may be formed integrally with at least one of the support portion SP11 of the leg portion LG11 and the inner surface IN2 of the support terminal 401F.

An example of a method of manufacturing the electron emission source 321R according to the present embodiment will be hereinafter explained with reference to FIG. 22A, FIG. 22B, FIG. 23A, and FIG. 23B.

First, the support terminal 401F is installed on the surface SF1 of the base PED. The distal portion TP11 of the leg portion LG11 of the filament FL1 is located between the electrodes EL1 and EL2. The steps of joining the distal portion TP11 of the leg portion LG11 and the support terminal 401F are the same as the steps explained with reference to FIG. 6 to FIG. 8B, and their explanations are omitted.

Figure 22A:
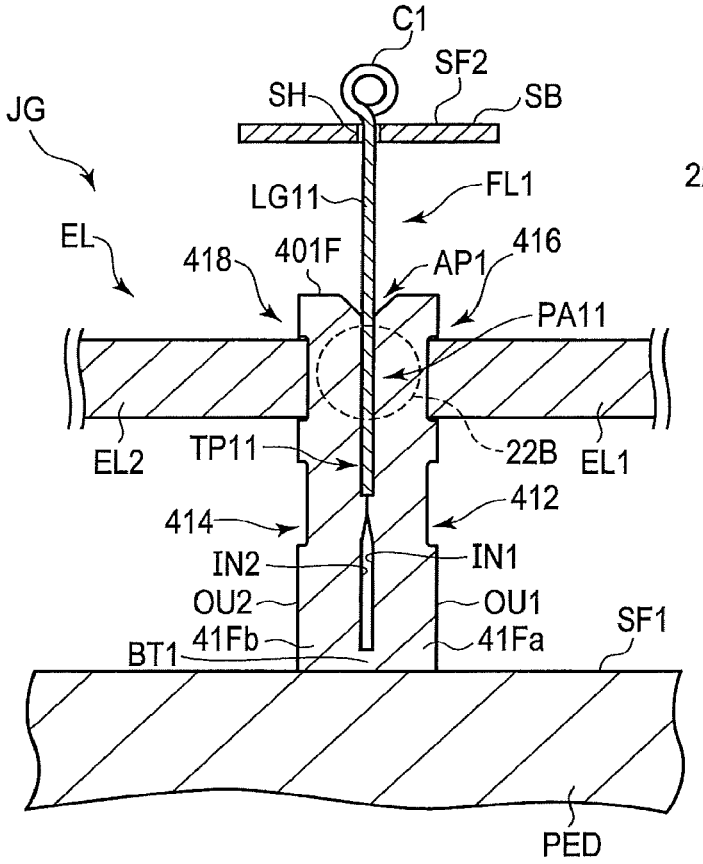
FIG. 22A is a cross-sectional view showing the filament and the support terminal installed in the jig.
Figure 22B:
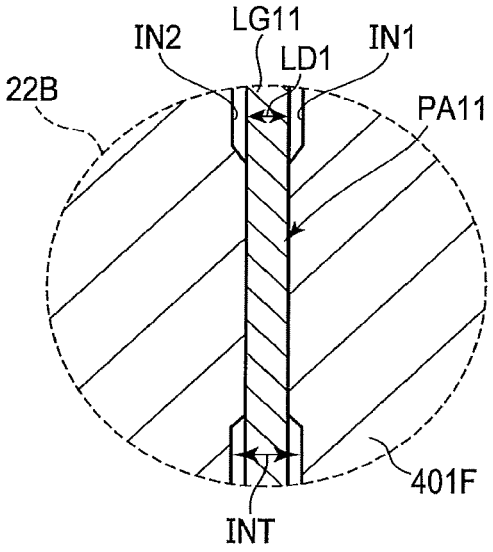
FIG. 22B is an expanded sectional view showing a support portion of the leg portion.

FIG. 22A and FIG. 22B are cross-sectional views showing an example of the support terminal 401F on which the force is exerted by the electrode EL. FIG. 22A is a cross-sectional view showing the filament FL1 and the support terminal 401F installed in the jig JG. FIG. 22B is an expanded sectional view showing the support portion TP11 of the leg portion LG11.

As shown in FIG. 22A, the electrodes EL1 and EL2 sandwich the support terminal 401F from both sides to exert force on the outer surfaces OU1 and OU2 of the support terminal 401F. The depressions 416 and 418 are formed on the outer surfaces OU1 and OU2 of the support terminal 401F by the electrodes EL1 and EL2, respectively.

As shown in FIG. 22B, the inner surfaces IN1 and IN2 of the support terminal 401F protrude to the support portion SP11 of the leg portion LG11 and are made to abut on the support portion SP11, by the force exerted by the electrodes EL1 and EL2. At this time, each of the inner surfaces IN1 and IN2 of the support terminal 401F is brought into line contact with the support portion SP11 of the leg portion LG11.

Figure 23A:
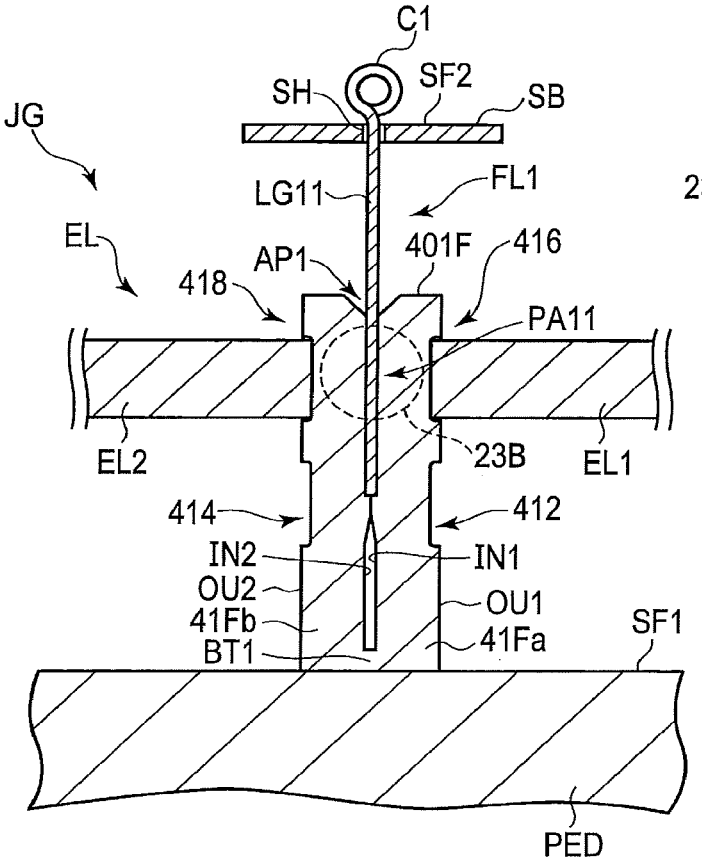
FIG. 23A is a cross-sectional view schematically showing the filament and the support terminal installed in the jig.
Figure 23B:
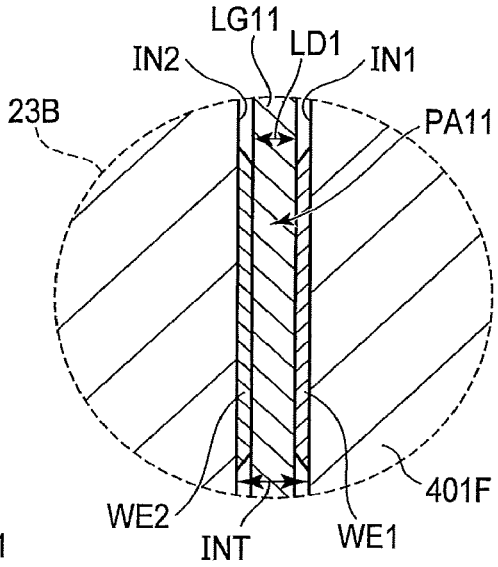
FIG. 23B is an expanded sectional view showing a support portion of the leg portion.

FIG. 23A and FIG. 23B are cross-sectional views showing the support terminal 401F joined to the support portion SP11 of the leg portion LG11. FIG. 23A is a cross-sectional view schematically showing the filament FL1 and the support terminal 401F installed in the jig JG. FIG. 23B is an expanded sectional view showing the support portion TP11 of the leg portion LG11.

In the example illustrated in FIG. 23A, the electrodes EL1 and EL2 supply a current while exerting force on the outer surfaces OU1 and OU2 of the support terminal 401F. At this time, each of the inner surfaces IN1 and IN2 of the support terminal 401F is molten and joined to the support portion SP11 of the leg portion LG11. As shown in FIG. 23B, for example, the joint portion WE1 is formed between the support portion SP11 of the leg portion LG11 and the inner surface IN1 of the support terminal 401F. The joint portion WE2 is formed between the support portion SP11 of the leg portion LG11 and the inner surface IN2 of the support terminal 401F. The joint portion WE1 is formed by meting at least one of the inner surface IN1 of the support terminal 401F and the support portion SP11 of the leg portion LG11. The joint portion WE2 is formed by meting at least one of the inner surface IN2 of the support terminal 401F and the support portion SP11 of the leg portion LG11.

Figure 24:
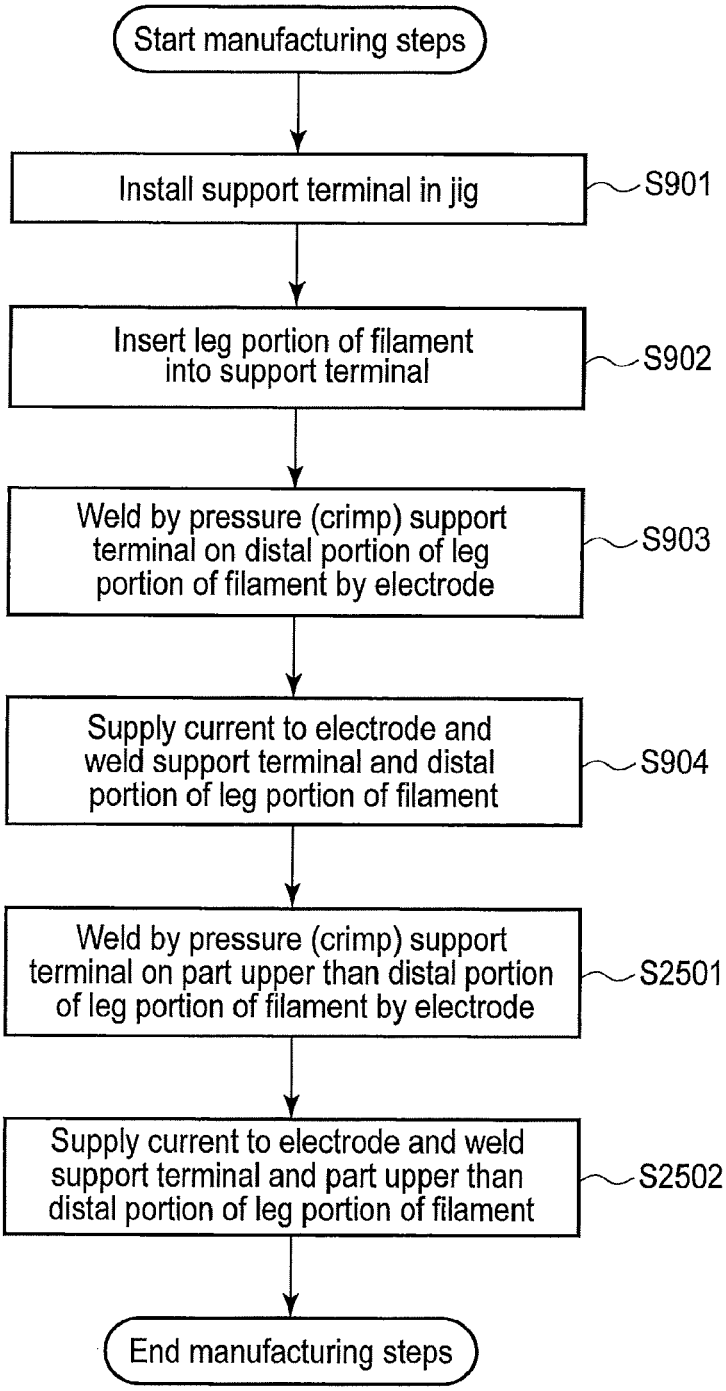
FIG. 24 is a flowchart showing an example of a method of manufacturing an electron emission source of an X-ray tube 1 according to the Second Embodiment.

FIG. 24 is a flowchart showing an example of a method of manufacturing the electron emission source 321R of the X-ray tube 1 according to the present embodiment. The same processing in the flowchart in FIG. 24 as that in the flowchart in FIG. 9 is denoted by the same reference numeral, and the detailed explanations are simplified or omitted.

First, the support terminal 401F is installed in the jig JG (S901), and the leg portion LG11 of the filament FL1 is inserted into the gap CL11 of the support terminal 401F (S902). The support terminal 401F is welded by pressure (crimped) on the distal portion TP11 of the leg portion LG11 by the electrodes EL1 and EL2 (S903).

In this state, the support terminal 401F is welded on the distal portion TP11 of the leg portion LG11 by the electrodes EL1 and EL2 (S904).

Furthermore, the support terminal 401F is welded by pressure (crimped) on an upper side (coil portion C1 side) than the distal portion TP11 of the leg portion LG11 by the electrodes EL1 and EL2 (S2501). At this time, the inner surfaces IN1 and IN2 are welded to the support portion SWP11 by the current supplied by the electrodes EL1 and EL2 while being made to abut on the support portion SP11 by the electrodes EL1 and EL2 with the force exerted on the electrodes EL1 and EL2, respectively (S2502). In the flowchart shown in FIG. 24, the processing of bringing the support terminal 401F into contact with the distal portion TP11 of the leg portion LG11 by pressure is performed prior to the processing of bringing the support terminal 401F into contact with the upper side of the distal portion TP11 of the leg portion LG11 by pressure, but may be performed after this processing. In addition, the welding step in S2502 may be omitted after the crimping step in S2501, in the flowchart shown in FIG. 24.

The X-ray tube 1, according to the Second Embodiment, is joined to the support terminal 401F by the support portion SP11 and the distal portion TP11 of the leg portion LG11 of the filament FL1. For this reason, the X-ray tube 1 can prevent displacement of the leg portions of the filament FL1, for example, the leg portion LG11. As a result, the X-ray tube 1 can prevent contact of the filament FL1 on the cathode cup 310, and the like.

In the Second Embodiment, the leg portion LG11 of the filament FL1 is fixed to the support terminal 401F at two portions but may be fixed at two or more portions. In addition, the support portion SP11 of the leg portion LG11 may not be fixed to the inner surfaces IN1 and IN2 of the support terminal 401F via the joint portions WE1 and WE2. For example, the support portion SP11 of the leg portion LG11 may be supported (welded by pressure or crimped) while sandwiched between the protruding inner surfaces IN1 and IN2. This corresponds to the case of omitting the welding step in S2502 after the crimping step in S2501, in the flowchart shown in FIG. 24.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube, comprising:

a cathode comprising:

a filament comprising a coil emitting electrons, and a leg portion extending in an extension direction from the coil to a distal portion and including a corner portion at the distal portion, a support terminal including a gap sequentially formed from an opening portion to a bottom portion in the extension direction, and a cathode cup accommodating the filament and the support terminal and being connected to the support terminal, the leg portion being inserted into the gap from the opening portion, the distal portion being located in the gap, and the support terminal comprising a protruding portion protruding in a direction intersecting the extension direction between the distal portion and the bottom portion in the gap, and fixed at the corner portion of the distal portion.

2. The X-ray tube of claim 1, wherein the protruding portion is separated from the bottom portion.

3. The X-ray tube of claim 1, wherein the protruding portion comprises a first protruding portion and a second protruding portion opposed to the first protruding portion, and the first protruding portion and the second protruding portion are separated in a distance smaller than a diameter of the leg portion.

4. The X-ray tube of claim 1, wherein the protruding portion comprises a first protruding portion and a second protruding portion opposed to the first protruding portion, and the first protruding portion and the second protruding portion are crimped or joined.

5. The X-ray tube of claim 1, wherein the support terminal comprises a first depression formed on an outer first surface, and a second depression formed on a second surface located outside on an opposite side with the first surface and the distal portion sandwiched between the first surface and the second depression.

6. The X-ray tube of claim 5, wherein the support terminal comprises a third surface crimped to a first portion of the leg portion located more closely to the coil side than the distal portion in the gap, and a fourth surface opposed to the third surface.

7. The X-ray tube of claim 5, wherein the support terminal comprises a third surface joined to a first portion of the leg portion located more closely to the coil side than the distal portion in the gap, and a fourth surface opposed to the third surface.

8. The X-ray tube of claim 6, wherein the support terminal comprises a third depression formed on an outer fifth surface, and a fourth depression formed on a sixth surface located outside on an opposite side with the first surface and the distal portion sandwiched between the fifth surface and the fourth depression.

9. The X-ray tube of claim 1, wherein the support terminal is formed of, iron, an alloy containing iron as a main component, niobium, an alloy containing niobium as a main component, molybdenum, or an alloy containing molybdenum as a main component.

10. The X-ray tube of claim 1, wherein the filament is formed of tungsten or an alloy containing tungsten as a main component.

11. A method of manufacturing an X-ray tube comprising a cathode, the cathode comprising:

a filament comprising a coil emitting electrons, and a leg portion extending from the coil to a distal portion and including a first corner portion and a second corner portion at the distal portion, a support terminal including a gap, and comprising an opening portion in which the gap is opened and a bottom portion located an end portion of the gap on a side opposite to the opening portion, and a cathode cup accommodating the filament and the support terminal and being connected to the support terminal, the method comprising:

inserting the distal portion of the leg portion into the gap of the support terminal;

supplying a current while applying a pressure to a first surface of the support terminal on an outer side and a second surface of the support terminal located outside on an opposite side with the leg portion sandwiched between the first surface and the second surface, by a pair of electrodes;

urging a third surface of the support terminal in the gap on a side opposite to the first surface to abut on the first corner portion;

joining the third surface to the first corner portion;

urging a fourth surface in the gap of the support terminal opposed to the third surface on a side opposite to the second surface to abut on the second corner portion;

joining the fourth surface to the second corner portion; and forming a protruding portion located more closely to the bottom portion side than to the distal portion at a position between the distal portion and the bottom portion, in the gap.

12. The method of claim 11, wherein a pressure is applied to a fifth surface of the support terminal on an outer side and a sixth surface of the support terminal located outside on an opposite side with a first portion of the leg portion located more closely to the coil side than the distal portion sandwiched between the fifth surface and the sixth surface, by a pair of electrodes, a seventh surface of the support terminal and an eighth surface opposed to the seventh surface are urged to abut on the first portion, and the seventh surface and the eighth surface are crimped to the first portion.

13. The method of claim 11, wherein a current is supplied while applying a pressure to a fifth surface of the support terminal on an outer side and a sixth surface of the support terminal located outside on an opposite side with a first portion of the leg portion located more closely to the coil side than the distal portion sandwiched between the fifth surface and the sixth surface, by a pair of electrodes, a seventh surface of the support terminal and an eighth surface opposed to the seventh surface are urged to abut on the first portion, and the seventh surface and the eighth surface are joined to the first portion.

* * * * *